US008381314B2

(12) United States Patent
Takamoto et al.

(10) Patent No.: US 8,381,314 B2
(45) Date of Patent: Feb. 26, 2013

(54) ATHLETIC WEAR

(75) Inventors: Yoshikuni Takamoto, Kobe (JP); Makoto Chinen, Kobe (JP); Yoshie Tsuji, Kobe (JP); Yuji Hashimoto, Kobe (JP); Mamoru Omuro, Kobe (JP)

(73) Assignee: Asics Corporation, Kobe (JP)

( * ) Notice: Subject to any disclaimer, the term of this patent is extended or adjusted under 35 U.S.C. 154(b) by 130 days.

(21) Appl. No.: 12/734,129

(22) PCT Filed: Oct. 15, 2007

(86) PCT No.: PCT/JP2007/070074

§ 371 (c)(1),
(2), (4) Date: Apr. 10, 2010

(87) PCT Pub. No.: WO2009/050769

PCT Pub. Date: Apr. 23, 2009

(65) Prior Publication Data

US 2010/0205713 A1 Aug. 19, 2010

(51) Int. Cl.
*A41B 9/00* (2006.01)

(52) U.S. Cl. ..... 2/78.3; 2/69; 2/243.1

(58) Field of Classification Search ..... 2/67, 243.1, 2/227, 228, 238, 400, 236, 78.3, 69
See application file for complete search history.

(56) References Cited

U.S. PATENT DOCUMENTS 5,109,546 A * 5/1992 Dicker ..... 2/70
5,131,100 A * 7/1992 Atwater et al. ..... 2/405
5,201,074 A * 4/1993 Dicker ..... 2/70
5,367,708 A * 11/1994 Fujimoto ..... 2/22
5,465,428 A * 11/1995 Earl ..... 2/238
5,737,773 A * 4/1998 Dicker et al. ..... 2/69
5,745,917 A * 5/1998 Dicker et al. ..... 2/69
5,867,827 A * 2/1999 Wilkinson ..... 2/69
5,888,118 A * 3/1999 Kishi ..... 450/122
6,047,405 A * 4/2000 Wilkinson ..... 2/69
6,047,406 A * 4/2000 Dicker et al. ..... 2/69
6,195,801 B1 * 3/2001 Meyers ..... 2/67
6,231,488 B1 * 5/2001 Dicker et al. ..... 482/124
(Continued)

FOREIGN PATENT DOCUMENTS

JP 2001-032104 2/2001
JP 2001-192903 7/2001
(Continued)

OTHER PUBLICATIONS

International Search Report of the International Searching Authority mailed Jan. 22, 2008, issued in connection with International Patent Appln. No. PCT/JP2007/070074 (4 pages).

*Primary Examiner* — Khoa Huynh
*Assistant Examiner* — Andrew W Collins
(74) *Attorney, Agent, or Firm* — Mintz, Levin, Cohn, Ferris, Glovsky and Popeo, P.C.

(57) ABSTRACT

An athletic wear 1 of the present invention is formed of first clothing fabric F1 having small elastic modulus and second clothing fabric F2 having larger elastic modulus than first clothing fabric F1. First belt part 10 is formed by second clothing fabric covering circumference of upper part of pelvis Bh in wear 1. First belt part 10 essentially continuously comprises belt front part 11, belt back part 13 and pair belt side parts 12 covering upper part of pelvis Bh. Upper edge line of belt part slopes as extends from center of belt back part to center of belt front part.

22 Claims, 16 Drawing Sheets

U.S. PATENT DOCUMENTS

| | | | | |
|---|---|---|---|---|
| 6,430,752 | B1 * | 8/2002 | Bay | 2/228 |
| 7,048,013 | B2 * | 5/2006 | Shannon | 139/422 |
| 7,159,621 | B2 * | 1/2007 | Shannon | 139/422 |
| 7,241,252 | B1 * | 7/2007 | Gagliardi | 482/124 |
| 7,509,822 | B2 * | 3/2009 | Ishida et al. | 66/177 |
| 7,526,929 | B2 * | 5/2009 | Takamoto et al. | 66/177 |
| 7,559,093 | B2 * | 7/2009 | Sudo et al. | 2/69 |
| 7,631,367 | B2 * | 12/2009 | Caillibotte et al. | 2/228 |
| 7,670,205 | B2 * | 3/2010 | Oyama et al. | 450/97 |
| 7,677,953 | B2 * | 3/2010 | Oyama et al. | 450/94 |
| 7,730,552 | B2 * | 6/2010 | Ota et al. | 2/69 |
| 7,814,576 | B2 * | 10/2010 | Nakazawa | 2/227 |
| 7,941,871 | B1 * | 5/2011 | Jorgensen | 2/238 |
| 7,945,970 | B2 * | 5/2011 | Belluye et al. | 2/69 |
| 2003/0028952 | A1 | 2/2003 | Fujii et al. | |
| 2004/0016043 | A1 * | 1/2004 | Uno et al. | 2/400 |
| 2004/0107479 | A1 * | 6/2004 | Dicker et al. | 2/227 |
| 2004/0111781 | A1 * | 6/2004 | Miyake et al. | 2/69 |
| 2004/0255358 | A1 * | 12/2004 | Ota et al. | 2/69 |
| 2005/0193461 | A1 * | 9/2005 | Caillibotte et al. | 2/69 |
| 2006/0130215 | A1 * | 6/2006 | Torry | 2/227 |
| 2007/0067892 | A1 | 3/2007 | Oyama et al. | |
| 2007/0256217 | A1 * | 11/2007 | Takamoto et al. | 2/401 |

FOREIGN PATENT DOCUMENTS

| | | | |
|---|---|---|---|
| JP | 2001-262409 | | 9/2001 |
| JP | 2003-049304 | | 2/2003 |
| JP | 2003-129310 | | 5/2003 |
| JP | 2004-107844 | | 4/2004 |
| JP | 2005-226217 | | 8/2005 |
| JP | 2005-281899 | | 10/2005 |
| WO | WO2004/096105 | A1 | 11/2004 |
| WO | WO2006/126300 | * | 11/2006 |

* cited by examiner

FIG.2B : Back view
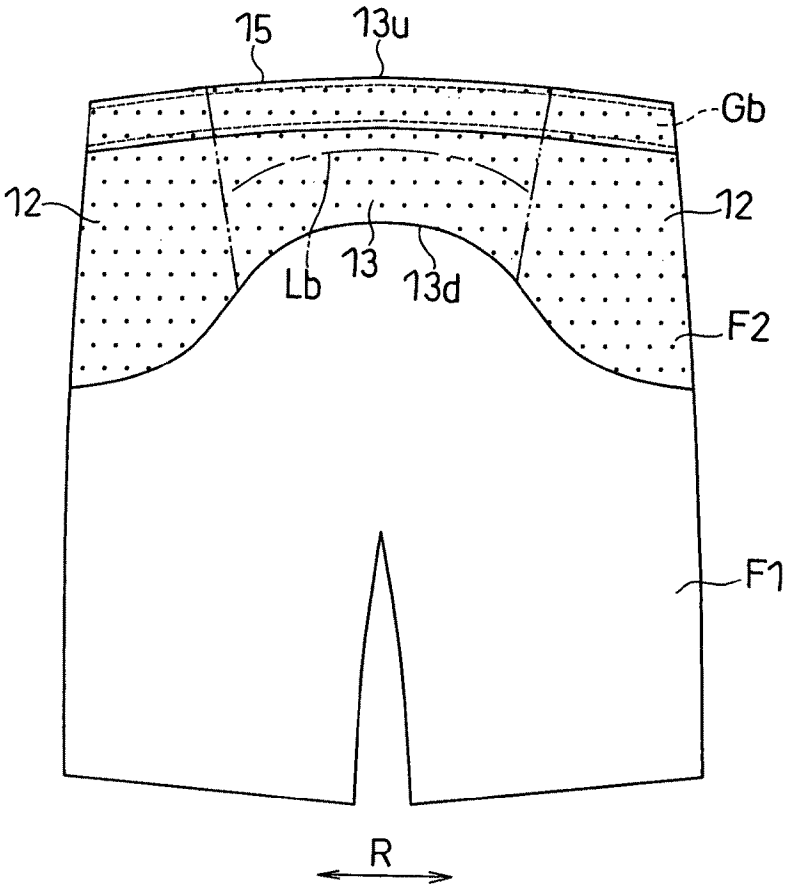
FIG.2A : Front view
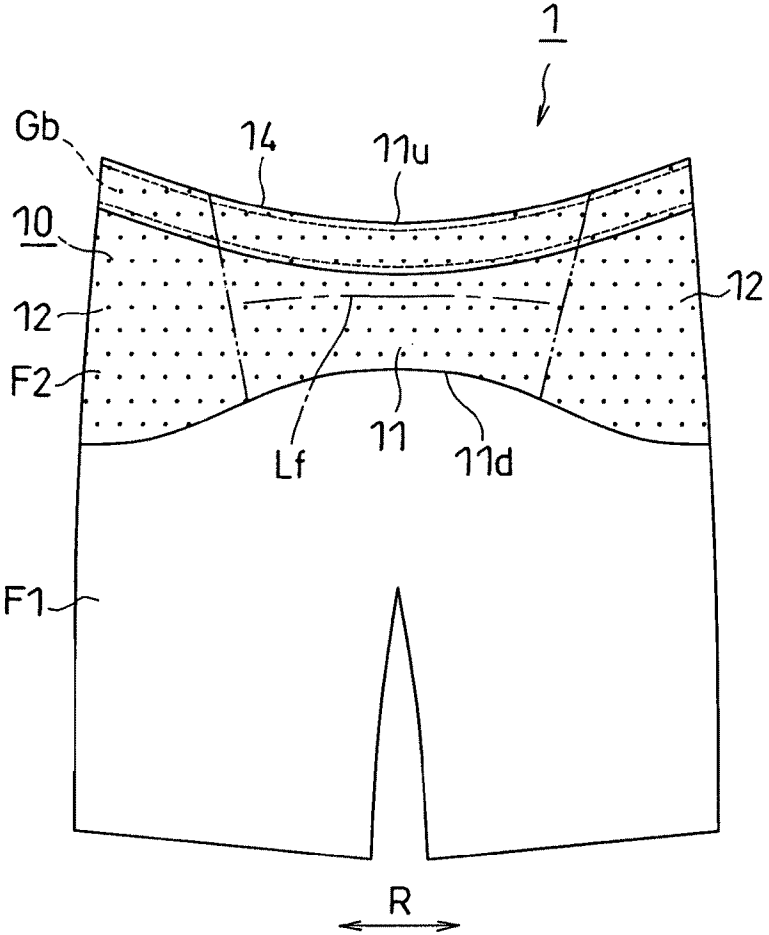

FIG.3A : Front view Prior Art
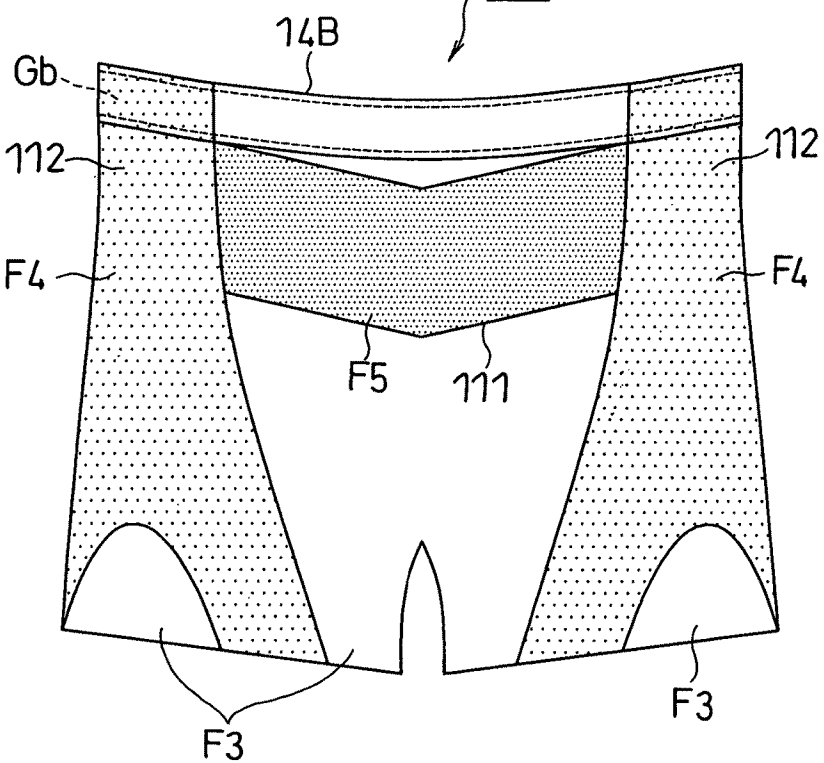
FIG.3B : Back view Prior Art
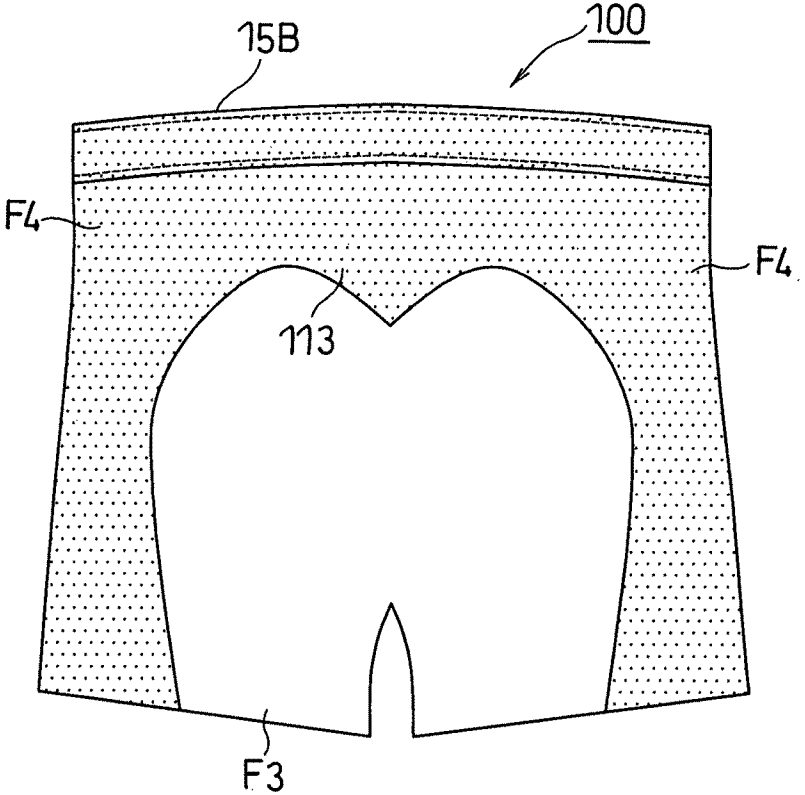

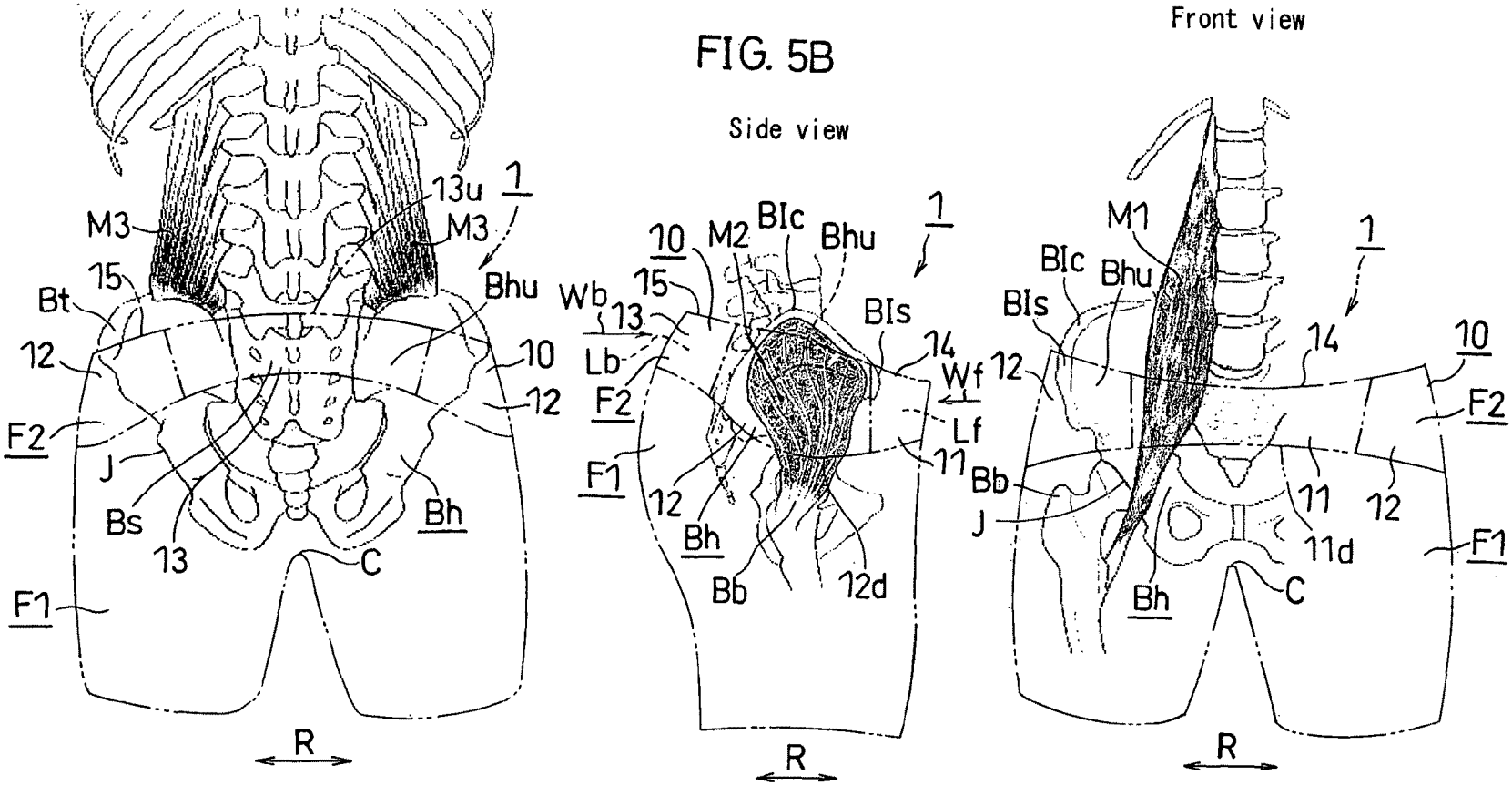
FIG.5A Front view
FIG. 5B Side view
FIG.5C Back view

Front view

Back view

Side view
1
10
11
12
13
14
14c
14u
15
15c
15u
101
102
103
F1
F2
H1
H2
Lb
LF

Front view
1B
10
14
14u
11
12
F2
F1
Tf
K

Back view
1B
10
15
15u
13
31
12
F2
22
Tb
F1
K
K1

Side view
1B
10
15c
14c
11
12
13
31
F2
F1
22
Tb
K

Front view

Back view

Side view

Back view

Side view

Front view

FIG. 11 A : Short-distance running
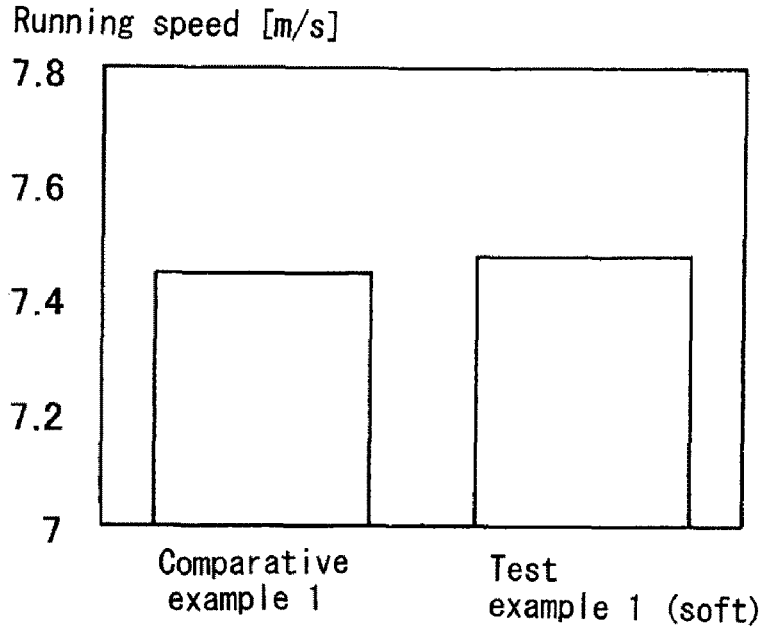
FIG. 11 B
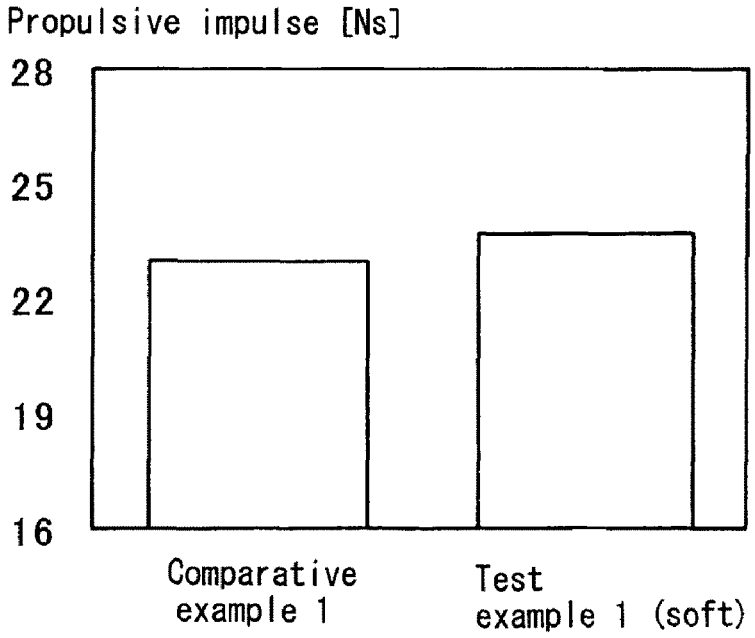

FIG. 12A : Change in kick motion
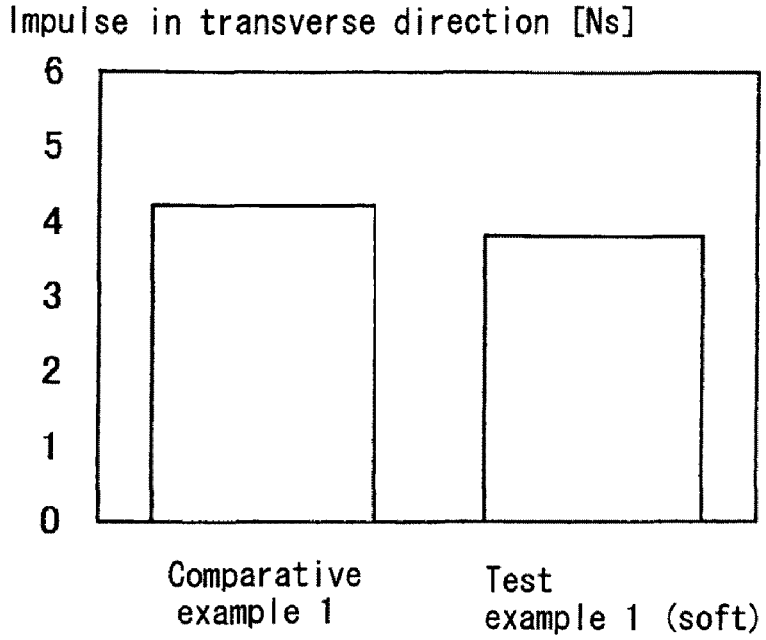
FIG. 12B
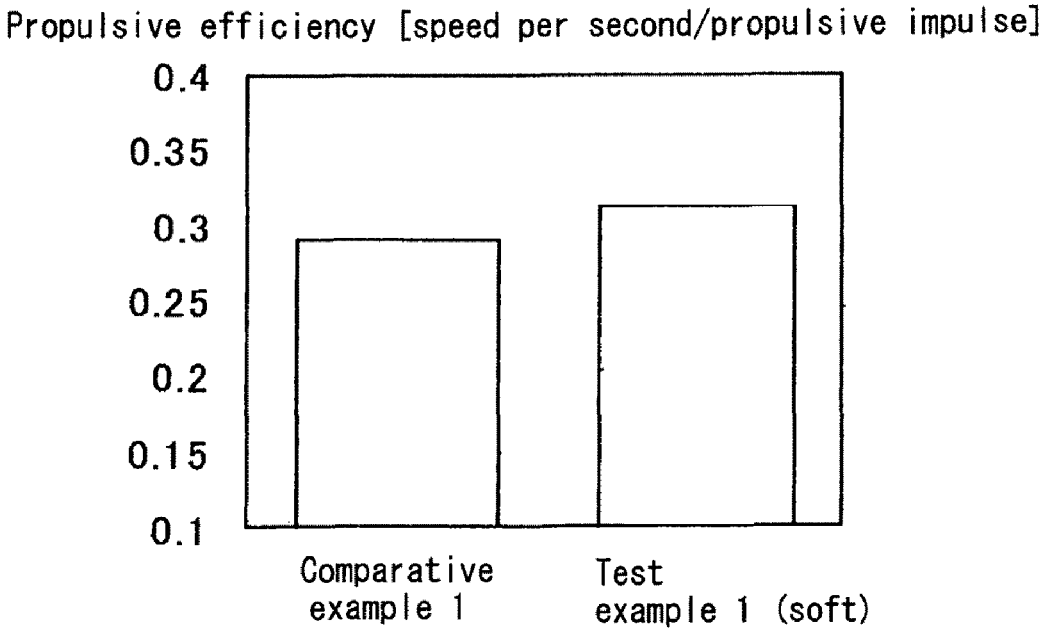

FIG.13A : Jump in vertical direction
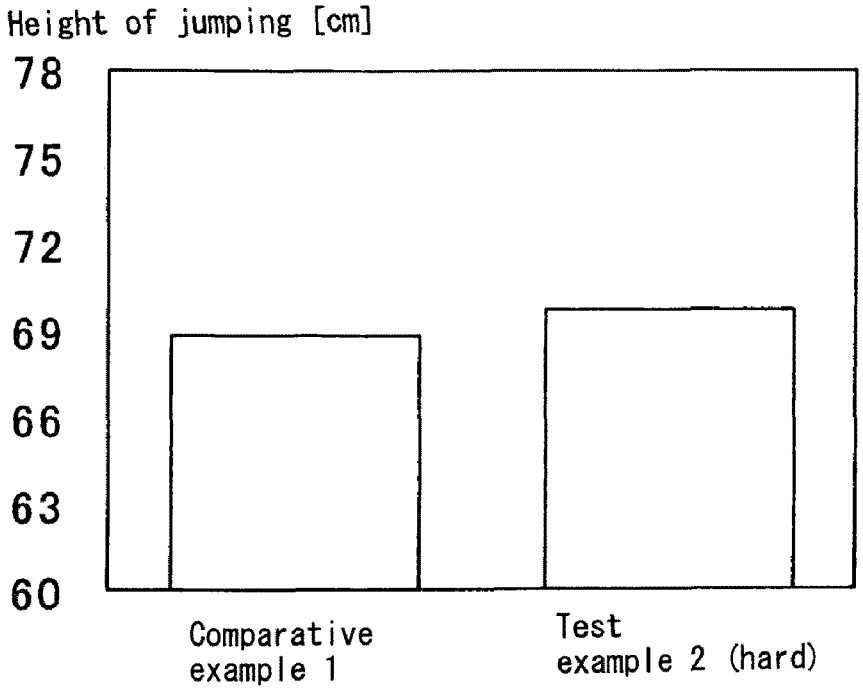
FIG.13B
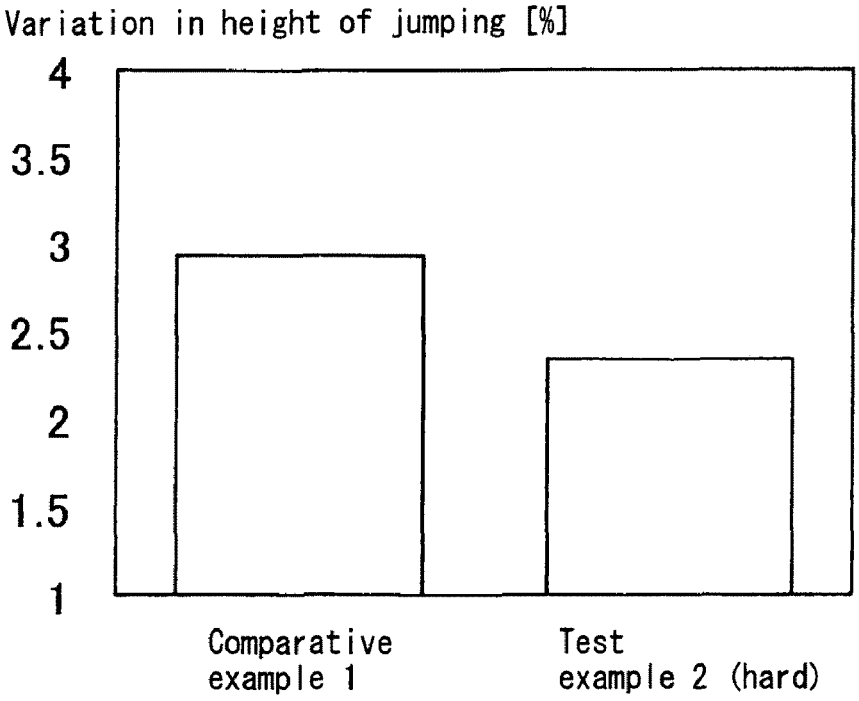

FIG.14A : Muscle efficiency (jump)
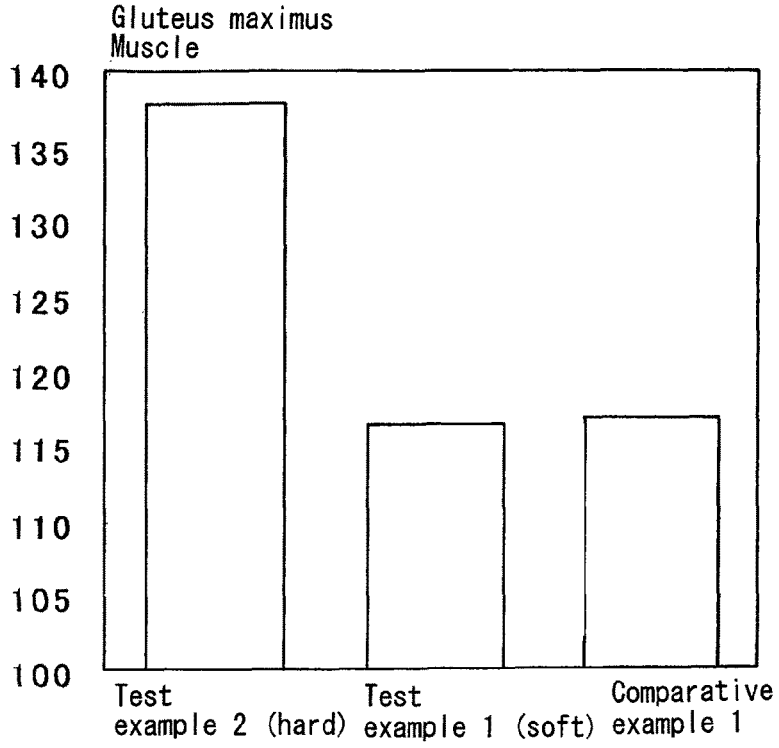
FIG.14B
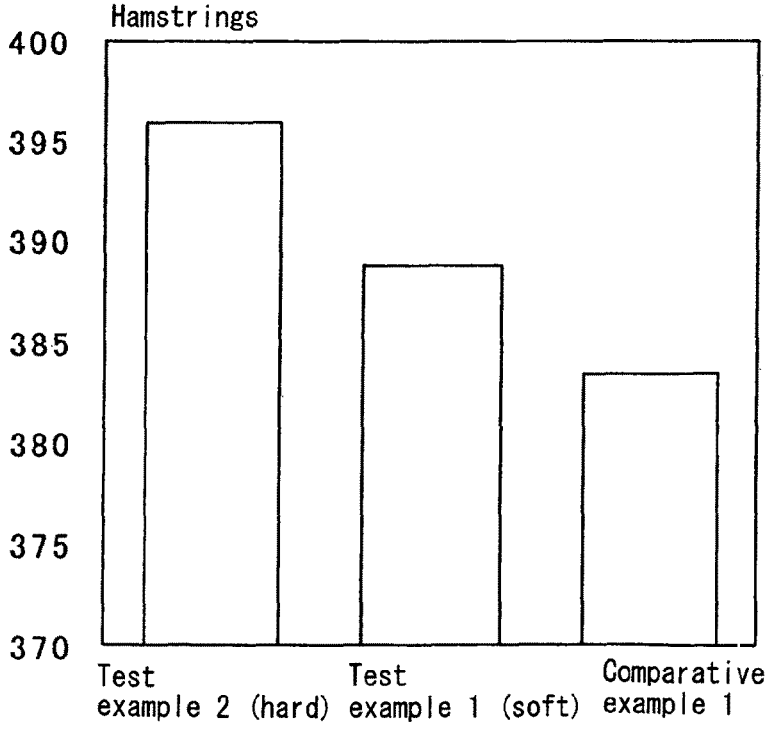

FIG.15A : Jump in vertical direction
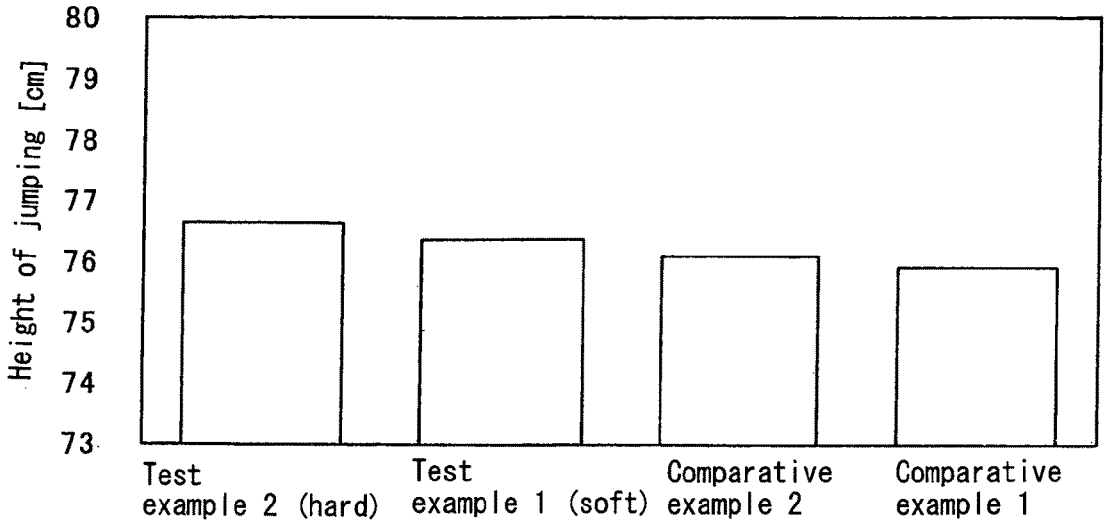
FIG.15B
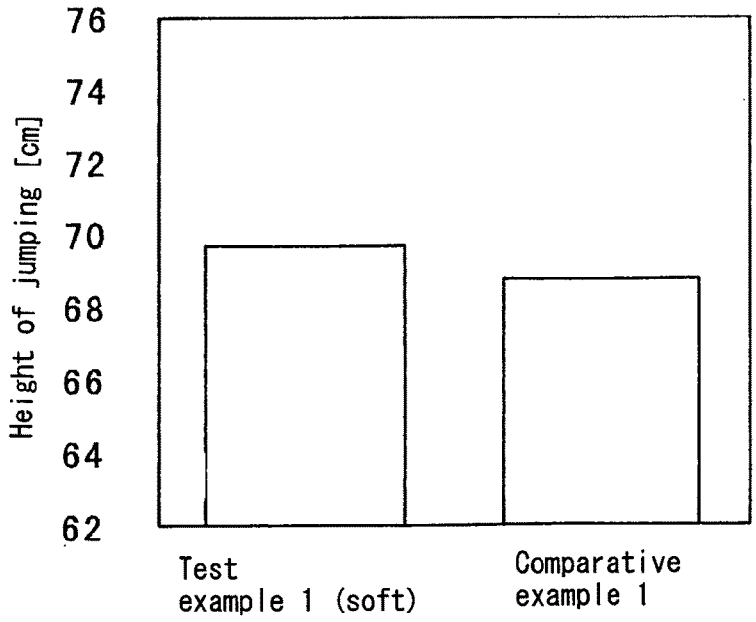

FIG.16A : Swimming
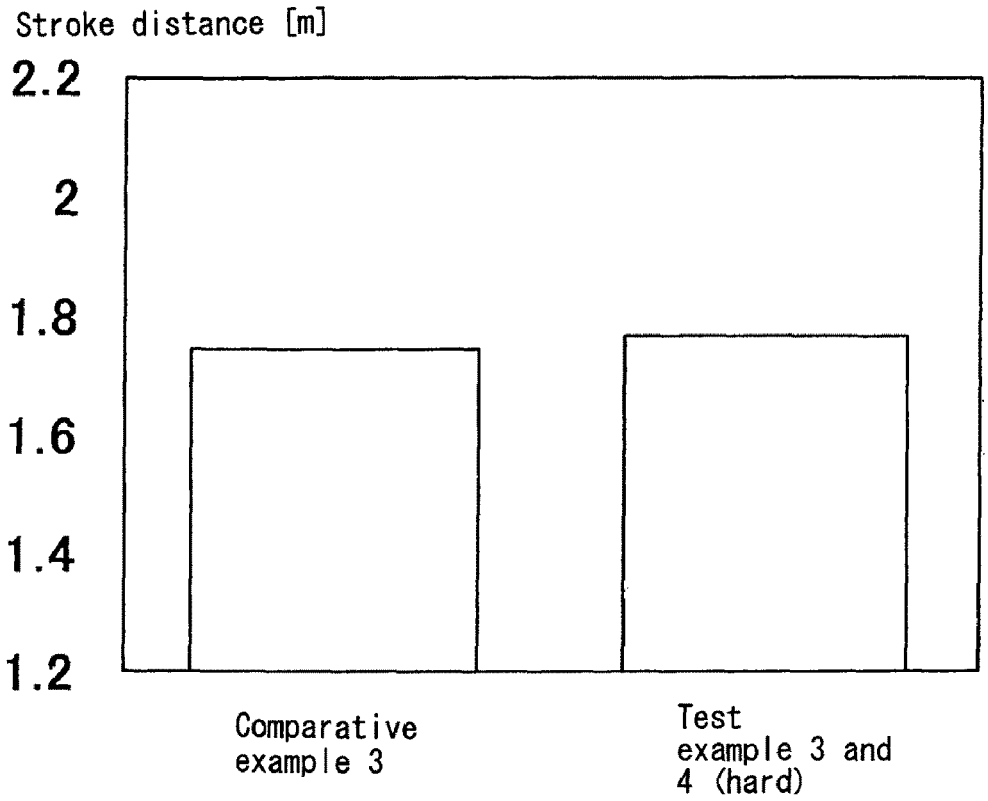
FIG.16B
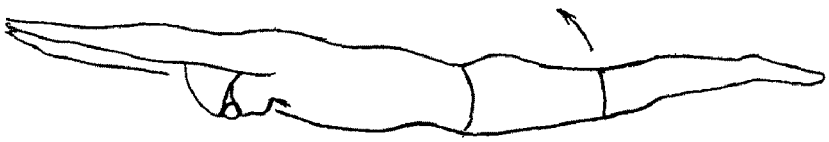

ATHLETIC WEAR

TECHNICAL FIELD

The present invention relates to an athletic wear improving an athletic performance of an athlete and, particularly, it is preferred to be employed as a swimwear (bathing suit).

BACKGROUND ART

A profile drag is the largest drag that the athletes encounter in water. The profile drag is influenced by a project area, which is seen from an anterior view of the traveling direction, of the athlete. Therefore, keeping a posture of the athlete parallel to water surface as far as possible is advantageous in order to reduce the profile drag. That is, it is desirable to prevent positions of the waist, knees and toes of the athlete from sinking relative to a position of the head of the athlete during swimming, and to keep the whole body posture parallel and straight to water surface as far as possible.

However, the athlete's posture tends to be unstable because of the action of gravity and buoyancy applying to the axis of the athlete. Meanwhile, the lower body has a greater bone density and a greater muscle mass than the upper body, so the lower body is easier to sink in water than the upper body.

The following first and second patent documents are disclosed based on the above viewpoint.

First patent document: Japanese Patent Laid Open No. 2001-32104

Second patent document: Japanese Patent Laid Open No. 2001-262409

Third patent document: Japanese Patent Laid Open No. 2003-129310

The swimwear disclosed in the Japanese Patent Laid Open No. 2001-32104 is formed of a flexible clothing fabric and covers continuously over the waist and thighs of the wearer, thereby aiming at preventing a body part from the waist to legs from sinking in water.

DISCLOSURE OF INVENTION

The swimmer needs some muscle force of an abdominal muscle and a back muscle to keep the advantageous posture. However, when the muscle is getting tired, it is difficult to keep the advantageous posture. The invention of the Japanese Patent Laid Open No. 2001-32104 does not consider muscle fatigue.

Japanese Patent Laid Open No. 2001-262409 discloses the swimwear extensively having a strong elastic-intensity material in order to tighten the waist of a swimmer by a predetermined pressure.

This prior art aims at postural stability during swimming by the action of more than a predetermined pressure on around the waist of the swimmer. However, it does not consider actively keeping the advantageous posture in water. So, a full advantage preventing the waist and thighs from sinking in water may not be expected.

In addition, the Japanese Patent Laid Open No. 2003-129310 discloses the swimwear in which the belt-like clothing fabric having small flexibility covers the waistline region that is above buttocks including the waist.

The swimwear of this prior art aims at advantages: when a person having fat around his waist wears the swimwear, it corrects his body shape; the swimwear allows a wearer to easily move around during water exercise.

The first object of the present invention is provide an athletic wear for swimming in which the swimmer's posture during swimming is easy to be the advantageous posture that is parallel and straight to water surface, and the swimmer is easy to keep the advantageous posture even if the swimmer's muscle fatigues.

In recent years, clothing correcting a wearer's posture has been invented, described as follows:

Fourth patent document: Japanese Patent Laid Open No. 2001-192903

Fifth patent document: Japanese Patent Laid Open No. 2005-281899

Sixth patent document: Japanese Patent Laid Open No. 2004-107844

The Japanese Patent Laid Open No. 2001-192903 discloses girdle-like clothing that is worn in daily life and sport and aims at improving range of motion of the waist and the hip joint. The girdle-like clothing in this prior art has the belt part having a strong tightening force, and the belt part extends along the waistline through the center position of the back of the waist. So, the center of the belt part may be arranged above the pelvis.

The Japanese Patent Laid Open No. 2005-281899 discloses girdle-like clothing that improves a wearer's posture, and is easy and comfortable to move. The girdle-like clothing of this prior art has more pressure to the waist on both waist side areas than on the waist and the abdominal. Also, in the girdle-like clothing of this prior art, the belt having a strong tightening force is central in an area that is 2 to 3 cm upper than the anterior superior iliac spine. So, the center of the belt may be arranged upper than the upper edge of the pelvis.

The Japanese Patent Laid Open No. 2004-107844 discloses the girdle-like clothing aiming to have a force acted on the pelvis, and the force is similar to a force on the pelvis acted by muscles around the pelvis. In the clothing of this prior art, the belt having strong tightening force does not cover the front surface of the pelvis. So, a force tightening the pelvis from its circumference may be weak.

So, the second object of the present invention is cover a predetermined area of the pelvis by a belt having a strong tightening force in order to improve an athletic performance of an athlete.

One aspect of an athletic wear of the present invention is directed to an athletic wear comprising flexible clothing fabrics, wherein the athletic wear is formed of a first flexible clothing fabric and a second flexible clothing fabric, an elastic modulus of the second clothing fabric along a waistline is larger than an elastic modulus of the first clothing fabric along the waistline, a crotch and a circumference of a lower part of a pelvis in the wear are covered with the first clothing fabric, a circumference of an upper part of the pelvis in the wear is covered with the second clothing fabric to form a belt-like first belt part, wherein the first belt part comprises essentially continuously: a belt front part covering a front surface of the upper part of the pelvis, a belt back part covering a back surface of the upper part of the pelvis, and a pair of belt side parts each covering a side surface of the upper part of the pelvis, the belt front part, the belt back part and the belt side parts are set individually to four regions into which the first belt part is equally divided in a circumferential direction, an upper edge line of the first belt part is sloped downward from the belt side part toward a center of the belt front part, a front upper edge line of the upper edge line of the belt front part is arranged in a level of one of an upper edge of the pelvis and a vicinity thereof, avoids essentially covering an upper area than the pelvis and avoids essentially covering an upper area than a back upper edge line of the upper edge line of the belt back part, a center of the back upper edge line is arranged in a region that is around 4 cm to 6 cm upper than a center of the front upper edge line, and the first belt part is formed so that a virtual back center line vertically dividing the belt back part into two parts is in a region that is 4 cm to 6 cm on an average upper than a virtual front center line vertically dividing the belt front part into two parts.

To stabilize the pelvis in back-and-forth and right-and-left results in stabilizing the upper body and the lower body and also stabilizing the athlete's posture in sport. And main muscles such as buttock muscle and thigh muscle used in running are connected to the pelvis. Muscle needs to be an appropriate length in order for the muscle to exert huge muscle power. When the pelvis backwardly inclines, muscle does not exert huge muscle power because the buttock muscle (gluteus maximus muscle) and thighs' back muscle (hamstring) that play a significant role during running are shrunk. When the pelvis is upstanding, these muscles are easy to exert muscle power because of appropriate length of these muscles.

According to the present invention, the pelvis hardly waves in back-and-forth and right-and-left and is stabilized, because the second clothing fabric having the large elastic modulus covers the upper part of the pelvis from its circumference. Since the belt back part is arranged in the area upper than the belt front part in the pelvis, offset couple applies to the pelvis as moment erecting the pelvis. As a result, the posture in which the pelvis erects is easy to be exerted.

In particular, even if muscles supporting bones got tired, the inclination of the pelvis is easy to be stabilized and the posture in which the pelvis erects is easy to be maintained. So, the gluteus maximus muscle and the hamstring is easy to be appropriate length, thereby muscle power is easy to be exerted.

In contrast, the second clothing fabric having large elastic modulus does not essentially cover the area upper than the pelvis. So, the second clothing fabric having large elastic modulus hardly bites into the wearer's waist in the area upper than the pelvis. Therefore, the second clothing fabric does not interfere with change of the circumferential length of the waist caused by breathing, and too much pressure on the abdominal hardly applies.

In the present invention, the first and the second clothing fabric may be either a single material or composite material. For example, the first clothing material may consist of a material covering over whole area of the wear as well as the second clothing fabric may be formed by lapping a toughened fabric like a toughened net over the material, by impregnating a material with plastic, or by coating plastic over the material.

In the present invention, the center of the back upper edge line is arranged in the region that is around 4 cm to 6 cm upper than the center of the front upper edge line, and the virtual back center line vertically dividing the belt back part into two equal-width parts is in the region that is 4 cm to 6 cm on an average upper than the virtual front center line vertically dividing the belt front part into two equal-width parts. The reason for numerical limitation to the edge lines and to the virtual center lines is as follows:

When a lower limit is fewer than 4 cm, the aforementioned couple of force is not exerted enough, so only insufficient advantage is achieved compared to when an upper edge of a wear is not offset.

When an upper limit is more than 6 cm, the lower edge of the belt front part is arranged near the lower limb, so the lower edge interferes with motions of the lower limb, or a vertical width of the belt is unnecessarily narrowed in order to prevent the lower edge of the belt front part from being arranged near the lower limb.

In the upper edge part of the first belt part, a rubber-like belt is arranged, and an enclosure in which the second clothing fabric is sewn into a bag-like in order to store the rubber-like belt in the enclosure. The upper edge part having the rubber-like belt and the enclosure has a remarkably large elastic modulus along the waistline. So, the position of the upper edge line of the first belt part plays a key element in exerting an appropriate couple of force.

That is, when a level difference between the center of the back upper edge and the center of the front upper edge is fewer than 4 cm, the aforementioned couple of force may not be exerted efficiently.

In contrast, when a level difference between the center of the back upper edge and the center of the front upper edge is more than 6 cm, either the upper edge of the belt back part covers an area upper than the ilium, or the lower edge line of the belt front part is arranged near the lower limb with the position of the rubber-like belt of the belt front part and/or the enclosure being lowly arranged. The belt front part arranged like this causes deterioration of wear-comfort and athletic performance.

In the present invention, the upper edge line of the first belt part is sloped downward from the center of the belt side part (both ends of the wear seen from an anterior view) toward the center of the belt front part. So, the front upper edge line of the belt front part is able to be arranged along the upper edge of the sacrum or vicinity thereof.

The wording of "the first belt part comprises essentially continuously: a belt front part, a belt back part and a pair of belt side parts" means that the first belt part composed of the second clothing fabric may be partially provided with the first clothing fabric (part having small elastic modulus may be included). Even if the first clothing fabric having small elastic modulus is slightly provided to the first belt part, great pressure is able to be applied over the pelvis from circumference of the pelvis.

The wording of "a front upper edge line of the upper edge line of the belt front part avoids essentially covering an upper area than the pelvis" means both the front upper edge line is arranged in the area upper than the upper edge of the front surface of the pelvis and the front upper edge line is arranged in the area lower than the upper edge of the pelvis in both ends of the front surface of the pelvis.

The wording of "a front upper edge line of the upper edge line of the front belt part avoids essentially covering an upper area than a back upper edge line of the upper edge line of the belt back part" means that when the belt back part is partially formed of the first clothing fabric, the front upper edge line may be arranged so that the front upper edge line crosses the part of the first clothing fabric.

Except for swimwear, it is preferred that an elastic modulus E1 along waistline of the first clothing fabric is set from 0.3 to 3.0 N/cm.

When an elastic modulus E1 of the first clothing fabric is fewer than 0.3 N/cm, the first clothing fabric may easily be peeled off during athletic. In contrast, when an elastic modulus E1 of the first clothing fabric is more than 3.0 N/cm, excessive tightening caused by the first clothing fabric may interfere motions of the lower limb.

Based on this view point, it is preferable that the elastic modulus E1 of the first clothing fabric is about 0.4 to 2.5 N/cm, and about 0.6 to 2.0 N/cm may be the most preferable as the elastic modulus E1.

Except for swimwear, it may be preferable that an elastic modulus E2 of the second clothing fabric along the waistline is set from 3.0 to 14.0 N/cm.

When an elastic modulus E2 of the second clothing fabric is fewer than 3.0 N/cm, enough couple of force may not be exerted because of insufficient pressure applied to the waist by the second clothing fabric. In contrast, when an elastic modulus E2 of the second clothing fabric is more than 14.0 N/cm, waist motions may be interfered or blood circulation may be impaired because of excessive tightening to the waist.

Based on this view point, it is preferable that the elastic modulus E2 of the second clothing fabric is about 4.0 to 12.0 N/cm, and about 4.5 to 11.0 N/cm is more preferable as the elastic modulus E2. And, it may be the most preferable that the elastic modulus E2 is 5.5 to 10 N/cm regardless of kinds of sports.

And, except for swimwear, it may be preferable that a value computed by dividing the elastic modulus E2 of the second clothing fabric by the elastic modulus E1 of the first clothing fabric (E2/E1) is set from 2.0 to 25.0.

When the value (E2/E1) is fewer than 2.0, either the elastic modulus E2 of the second clothing fabric may decrease too much or the elastic modulus E1 of the first clothing fabric may increase too much. So, pressure applying to outer circumference of the pelvis may be insufficient, or excessive pressure may be applied to the lower limb.

In contrast, when the value (E2/E1) is more than 25.0, either the elastic modulus E1 of the first clothing fabric will decrease too much or the elastic modulus E2 of the second clothing fabric may increase too much. So, excessive pressure may be applied to the outer circumference of the pelvis, or exercise may be interfered with by the first clothing fabric peeling off.

Based on this view point, it is preferable that the value (E2/E1) is about 3.0 to 20, and about 4.0 to 18.0 is the most preferable as the value.

And, except for swimwear, it is preferable that a value computed by subtracting the elastic modulus E1 of the first clothing fabric from the elastic modulus E2 of the second clothing fabric (E2-E1) is set from 2.7 to 13.7 N/cm.

When the value (E2-E1) is fewer than 2.7 N/cm, either the elastic modulus E2 of the second clothing fabric will decrease too much or the elastic modulus E1 of the first clothing fabric may increase too much. So, pressure applying to the circumference of the pelvis may be insufficient, or excessive pressure may be applied to the abdominal.

In contrast, when the value (E2-E1) is more than 13.7 N/cm, either the elastic modulus E1 of the first clothing fabric may decrease too much or the elastic modulus E2 of the second clothing fabric will increase too much. So, excessive pressure may be applied to the circumference of the pelvis, or exercise may be interfered with by the first clothing fabric peeling off.

Based on this viewpoint, it is preferable that the value (E2-E1) is 3.6 to 11.6 N/cm, and 3.9 to 10.4 N/cm is the most preferable as the value.

Based on combination of the above viewpoints, except for swimwear, it may be preferable that the elastic modulus of the first clothing fabric along the waistline is set from 0.3 to 3.0 N/cm, the elastic modulus of the second clothing fabric along the waistline is set from 3.0 to 14.0 N/cm, the value obtained by dividing the elastic modulus of the second clothing fabric by the elastic modulus of the first clothing fabric is set from 2.0 to 25.0, and the value obtained by subtracting the elastic modulus of the first clothing fabric from the elastic modulus of the second clothing fabric is set from 2.7 to 13.7 N/cm.

In addition, except for swimwear, it may be more preferable that the elastic modulus of the first clothing fabric is set from 0.4 to 2.5 N/cm, the elastic modulus of the second clothing fabric is set from 4.0 to 12.0 N/cm, the value obtained by dividing the elastic modulus of the second clothing fabric by the elastic modulus of the first clothing fabric is set from 3.0 to 20.0, and the value obtained by subtracting the elastic modulus of the first clothing fabric from the elastic modulus of the second clothing fabric is set from 3.6 to 11.6 N/cm.

Except for swimwear, it may be furthermore preferable that the elastic modulus of the first clothing fabric is set from 0.6 to 2.0 N/cm, the elastic modulus of the second clothing fabric is set from 4.5 to 11.0 N/cm, the value obtained by dividing the elastic modulus of the second clothing fabric by the elastic modulus of the first clothing fabric is set from 4.0 to 18.0, and the value obtained by subtracting the elastic modulus of the first clothing fabric from the elastic modulus of the second clothing fabric is set from 3.9 to 10.4 N/cm. In the most preferable example, the elastic modulus of the second clothing fabric is set from 5.5 to 10.0 N/cm regardless of kinds of sports.

In swimwear, since water flowing into a space between a clothing fabric and skin surface of an wearer causes great drag, it is preferable that a clothing fabric is in close contact with skin surface of an wearer. So, it is preferable that the elastic modulus of the first clothing fabric is large.

Meanwhile, when the elastic modulus E1 of the first clothing fabric is large, if the elastic modulus E2 of the second clothing fabric is excessive, tightening force of a whole wear applying to an wearer's body is excessive. And, in swimwear, a swimmer wears a swimwear that is in well stretched shape. So, although the elastic modulus of the second clothing fabric itself is small, pressure applying to the swimmer's waist is large.

Based on this viewpoint, in swimwear, it may be preferable that the elastic modulus of the first clothing fabric is set from 1.2 to 3.5 N/cm, the elastic modulus of the second clothing fabric is set from 5.0 to 14.0 N/cm, the value obtained by dividing the elastic modulus E2 of the second clothing fabric by the average of the elastic modulus E1 of the first clothing fabric is set from 1.5 to 7.0, and the value obtained by subtracting the elastic modulus E1 of the first clothing fabric from the elastic modulus E2 of the second clothing fabric is set from 3.7 to 12.0 N/cm.

In swimwear, it may be more preferable that the elastic modulus of the first clothing fabric is set from 1.5 to 3.0 N/cm, the elastic modulus of the second clothing fabric is set from 5.5 to 10.0 N/cm, the value obtained by dividing the elastic modulus E2 of the second clothing fabric by the elastic modulus E1 of the first clothing fabric is set from 1.9 to 6.0, and the value obtained by subtracting the elastic modulus E1 of the first clothing fabric from the elastic modulus E2 of the second clothing fabric is set from 2.5 to 8.5 N/cm.

In swimwear, it may be the most preferable that the elastic modulus of the first clothing fabric is set from 1.7 to 2.8 N/cm, the elastic modulus of the second clothing fabric is set from 6.0 to 9.0 N/cm, the value obtained by dividing the elastic modulus E2 of the second clothing fabric by the elastic modulus E1 of the first clothing fabric is set from 2.2 to 4.0, and the value obtained by subtracting the elastic modulus E1 of the first clothing fabric from the elastic modulus E2 of the second clothing fabric is set from 4.3 to 7.2 N/cm.

In swimwear, the front thighs in which muscles move widely may be covered by a clothing fabric having smaller elastic modulus (first clothing fabric), and the hypogastrium, buttocks and posterior region of the thighs may be covered by a clothing fabric having a bit larger elastic modulus (first clothing fabric). When two or more different clothing fabric each having different elastic modulus is contained in the first and/or the second clothing fabric, the elastic modulus of the clothing fabric is defined by the average in not only swimwear but all kinds of wears.

In the present invention, since the elastic modulus E1 and E2 set pressure applying to the waist during wearing, the elastic modulus E1 and E2 are needed to be defined by the value obtained during wearing. Meanwhile, elastic modulus of clothing fabric is influenced by amount of stretch unlike elastic modulus of metallic material. So, in the present invention, the elastic modulus is defined as follows in the light of the reproducibility of elastic modulus.

That is, as shown in the following formula (1), the elastic modulus means intensity of load in relation to stretch per unit when a clothing fabric is stretched to increase by 20% in width per unit.

$$E=(F/W)/\Delta \quad (1)$$

E: elastic modulus

F: load in clothing fabric stretching by 20%

W: width of sample

Δ: 0.2 (strain)

Thickness of clothing fabric is not considered because the elastic modulus in the present invention is intensity of load per unit width in clothing fabric.

In addition, "stretch per unit" means stretch per unit length in clothing fabric.

Also, when the first or the second clothing fabric is composite material, a value is defined by calculating as the first and second clothing fabric is composite.

In contrast, the rubber-like belt and the enclosure, which is formed into bag-like by folding the second clothing fabric so as to store the rubber-like belt, have large elastic modulus locally. The enclosure is excluded from the definition of the elastic modulus in the specification herein.

In the preferred embodiment of the present invention, the upper edge part of the first belt part is provided with the enclosure that is continuous with the waistline (torso), the enclosure is formed by folding the second clothing fabric so that the second clothing is doubled, and the enclosure stores the rubber-like belt having rubber elasticity that stretches along the waistline.

As aforementioned, the elastic modulus of the upper edge part of the first belt part having the enclosure and the rubber-like belt is markedly larger than the elastic modulus of the other parts. So, since the enclosure and the rubber-like belt are each continuous in the waistline (around torso) in the upper edge part of the first belt part, great couple of force is exerted in the waist during wearing.

The rubber-like belt herein having rubber elasticity includes: a belt formed in thread rubber or sheet rubber, a belt formed by looming a thread rubber, a belt formed by impregnating a material with plastic, or by coating plastic over the material, and a thread-like or strip-shaped belt out of thermoplastic elastomer having great elasticity.

And "rubber elasticity" means property in which a belt is able to deform greatly (e.g., fracture elongation is 100% or more) and a belt restores its original shape upon removal of pressure.

In the more preferable embodiment of the present invention, the elastic modulus of the rubber-like belt is set from 17 to 40 N/cm, and the width of the rubber-like belt is set from 2.0 to 3.5 cm.

In this case, great couple of force is exerted because the elastic modulus of the rubber-like belt is large and the width of the rubber-like belt is enough.

The advantage of the present invention is achieved by pressure and moment that the wear applies to the pelvis of the wearer during wearing. So, normally, the following measure needs to be employed: first, dressing a mannequin in the wear, and then measuring pressure distribution over the surface of the mannequin, and considering the measured value as parameter. However, in the above measurement of the pressure distribution, obtained data differs when using different types of mannequin. So, in the specification herein, the elastic modulus of the clothing fabric is employed as parameter.

It may be preferable that the average width of the belt front part in the vertical direction is about from 3 to 12 cm, and about from 4 to 10 cm may be more preferable as the average width.

Meanwhile, it may be preferable that the average width of the belt back part in the vertical direction is about from 5 to 12 cm, and about from 6 to 10 cm is more preferable as the average width.

When the width of the first belt part is too much large, the advantage of offset position is difficult to be achieved. Meanwhile, when the width of the first belt part is too much small, pressure applies the wearer locally and excessively.

In the present invention, it is preferable that the front upper edge line of the belt front part is formed to be convexed downward, and the back upper edge line of the belt back part is formed as being convexed upward or being generally horizontal.

Since the upper edge of the first belt part is formed as described above, the front upper edge line of the first belt part curves gently as extending from the center of the back surface toward the center of the front surface through the side parts, and the front upper edge line is a natural line.

In this case, it is more preferable that the lower edge line of the belt front part is formed to be convexed upward, and the lower edge line of the belt back part is formed to be convexed upward.

In this embodiment, the width of the belt side parts in the vertical direction is large. Since the width of the belt side parts in the vertical direction is large, stability of the pelvis in the right-and-left direction improves.

In the present invention, it is preferable that the first belt part covers at least a part of the anterior superior iliac spine in a vicinity of both ends of the front surface, and covers a part of the iliopsoas, and the belt back part covers a part of the sacrum.

In this arrangement, it is achieved that the pelvis stabilizes by the first belt part covering both bone and muscles, and the activity of the iliopsoas that is considered as deep muscle improves by the first belt part pressuring the iliopsoas.

In this case, it is preferable that the belt back part covers the upper edge of the sacrum or the vicinity thereof but does not cover the lower edge of the sacrum.

Arranging the belt back part as described above increases the amount of offset between force applying to the pelvis from the back surface and force applying to the pelvis from the front surface. Therefore the posture with the pelvis erecting is easy to be achieved.

In addition, it is preferable that the belt side parts are arranged in an area that is lower than the iliac crest and upper than the greater trochanter.

The belt side parts apply force to the gluteus medius muscle between the iliac crest and the greater trochanter, preventing unintended motions of the gluteus medius muscle in right-and-left direction, and enhancing actions of the gluteus medius muscle. As a result, the pelvis and the lower limb are stable in the right-and-left direction, improving athletic performance.

In this case, it is preferable that the lower edge line of the belt side parts is formed to be convexed downward toward a vicinity of the center in the circumferential direction of the belt side parts, and the lowermost end of the belt side parts is adjacent to the greater trochanter. And, it is preferable that the height of the belt side parts is set from ½ to ⅘ of the distance between the greater trochanter and the iliac crest.

The belt side parts press the gluteus medius muscle widely between the iliac crest and the trochanter, improving action of the gluteus medius muscle. When the belt side parts do not cover the trochanter, actions of the legs move smoothly.

The present invention is preferably employed as swimwear.

When offset force applies to the pelvis, force lifting the heavy lower limb up upward applies to the pelvis during swimming. So, the waist does not sink and the posture of the swimmer remains stable if muscle fatigue occurs during swimming. As a result, it is easy for the swimmer's posture to be the effective posture that is parallel to water surface and straight, and is easy to keep the effective posture even if muscles fatigue.

In swimwear, it is preferable that a swimwear further comprises a pair of second belt parts formed of a clothing fabric that differs from the first clothing fabric, wherein an elastic modulus of the second belt parts in the longitudinal direction is larger than the elastic modulus of the first clothing fabric, and the second belt parts each have a first connection part at which an upper end of the second belt part is connected to a lower end of the first belt part at a posterior region of a thigh in an outer side of the pelvis, and are formed like a belt toward an inner side of a knee from the first connection part.

Arranging the second belt part on the virtual line connecting the outer side of the pelvis of the posterior thigh and the medial side of the knee improves: a function that helps actions of the hamstrings and the gluteus maximus muscle that extends the hip joint; and a function that rotates the hip joint medially. Extending the hip joint prevents the waist from sinking during swimming.

In swimwear, it is more preferable that a swimwear comprises a pair of third belt parts formed of a clothing fabric that differs from the first clothing fabric, wherein an elastic modulus of the third belt parts in the longitudinal direction is larger than the elastic modulus of the first clothing fabric, and the third belt parts each are formed like a belt toward the outer side of the knee from around the upper edge of the anterior region of the thigh.

Arranging the third belt parts on the virtual line connecting the medial side of the vicinity of the upper end of the anterior thigh and the lateral side of the knee improves; a function that helps actions of adductor muscle group that rotates the hip joint medially; and a function that rotates the hip joint medially. Adducting or medially rotating the hip joint achieves that the lower limb or the legs is able to catch more water during kicking in water.

In a running tights having a leg portion that covers below the knee, it is preferable that the wear further comprises a support part formed of the second clothing fabric to cover at least a front surface above around the knee, and a connection part connecting the support part and the belt side parts along a longitudinal direction of the leg.

In this case, the support part suppresses vibration of the thigh. And, connecting the support part to the belt part stabilizes the lower limb in right-and-left direction. The support part also stabilizes rotation of the knee joint and the hip joint.

BRIEF DESCRIPTION OF DRAWINGS

FIG. 2A is a schematic front view showing a pants-type athletic wear, FIG. 2B is a back view showing the pants-type athletic wear.

FIG. 3A is a schematic front view showing a conventional pants-type wear, FIG. 3B is a back view showing of the conventional pants-type wear.

FIG. 5A is a schematic front view, FIG. 5B is a schematic side view and FIG. 5C is a schematic back view and FIG. 5A to FIG. 5C each show a relationship between the athletic wear and bones and muscles.

FIG. 11A is a bar graph showing measurements of running speed in a wear used as a comparative example and test example, FIG. 11B is a bar graph showing measurements of propulsive impulse in a wear used as a comparative example and test example.

FIG. 12A is a bar graph showing measurements of an impulse in a transverse direction in a wear used as a comparative example and test example, FIG. 12B is a bar graph showing measurements of propulsion efficiency in a wear used as a comparative example and test example.

FIG. 13A is a bar graph showing measurements of height of jumping in a wear used as a comparative example and test example, FIG. 13B is a bar graph showing measurements of variation in height of jumping in a wear used as a comparative example and test example.

FIG. 14A is a bar graph showing measurements of muscle efficiency of the gluteus maximus muscle in a wear used as a comparative example and test example, FIG. 14B is a bar graph showing measurements of muscle efficiency of hamstrings in a wear used as a comparative example and test example.

FIG. 15A and FIG. 15B each is a bar graph showing measurements of height of jumping in a wear used as a comparative example and test example.

FIG. 16A is a bar graph showing measurements of stroke length during swimming in a wear used as a comparative example and test example, FIG. 16B is a side view showing a posture in water.

DESCRIPTION OF REFERENCE NUMERALS

Figure 1B:
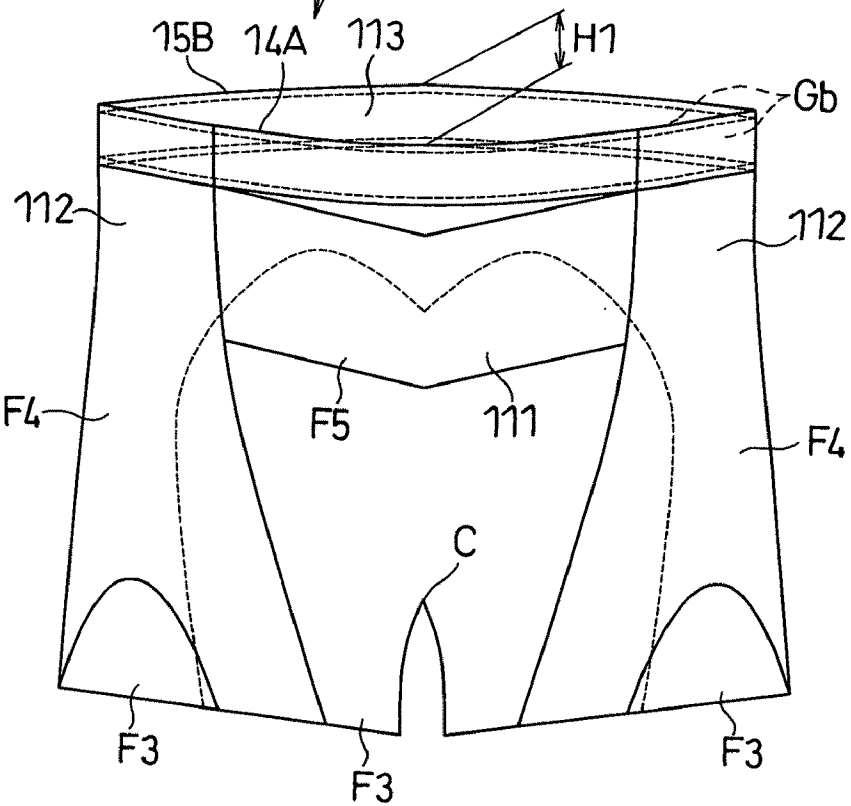
FIG.1B Prior Art
FIG. 1B is a schematic front view showing a conventional pants-type wear.

1: Pants-type athletic wear
10: First belt part
11: Belt front part

12: Belt side part
13: Belt back part
14: Front upper edge line of first belt part
15: Back upper edge line of first belt part
17: Leg part
22: Second belt part
23: Third belt part
24: Second connection part
25: First support part
26: Second support part
200: Calf
31: First connection part
101: First area
102: Second area
103: Third area
F: Clothing fabric
Fb: Fabric
Fs: Reinforcing fabric
H1: Offset amount of upper edge line
H2: Offset amount of center line
M1: Iliopsoas
M2: Gluteus medius muscle
M3: Quadratus lumborum muscle
Bb: Greater trochanter
Bf: Thighbone
Bh: Pelvis
Bs: Sacrum
Bt: Ilium
Bhu: Upper part of pelvis
Blc: Iliac crest
Bls: Anterior superior iliac spine
Gb: Rubber-like belt
Gs: Enclosure
Tu: Medial side of vicinity of upper edge of anterior thigh Tf
Tf: Anterior thigh
Tb: Posterior thigh
J: Hip joint
K: Knee

BEST MODE FOR CARRYING OUT THE INVENTION

The present invention will be understood more clearly from the following description of preferred embodiments taken in conjunction with the accompanying drawings. Note however that the embodiments and the drawings are merely illustrative, and the scope of the present invention shall be defined by the claims. In the accompanying drawings, like reference numerals denote like components throughout the plurality of figures.

First Embodiment

A first embodiment of the present invention is described below with reference to FIG. 1A, FIG. 2A, FIG. 2B and FIGS. 4A to 5C.

Figure 4A:
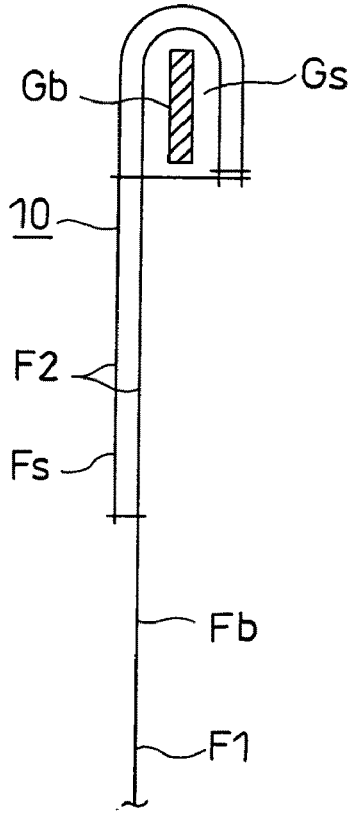
FIG. 4A is a schematic cross sectional view showing a partially broken athletic wear of the first embodiment of the present invention.
Figure 4B:
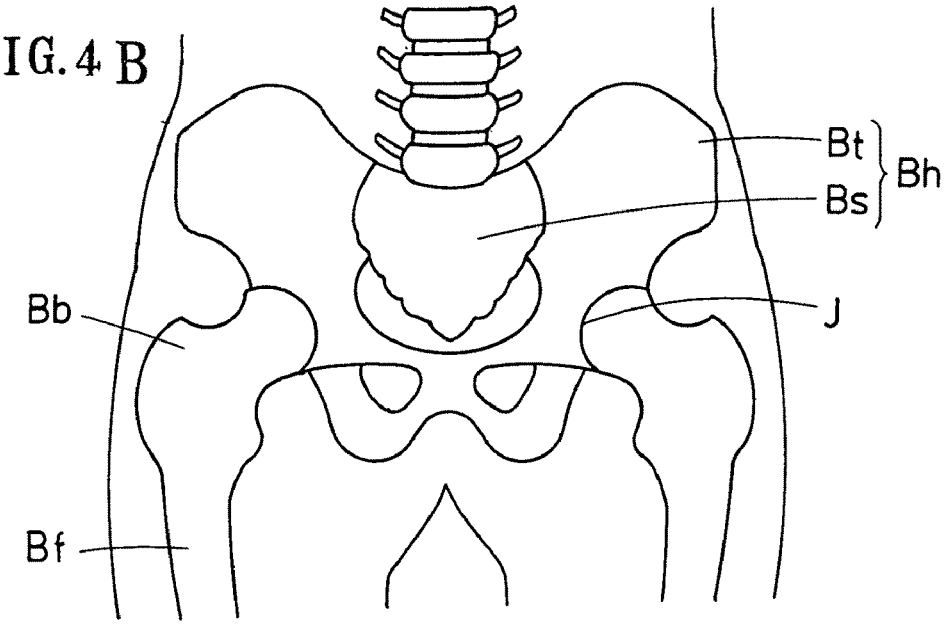
FIG. 4B is a front view showing a part of human skeleton.

In FIG. 4B, a pelvis Bh comprises an ilium Bt and a sacrum Bs. A thighbone Bf connects to the pelvis Bh via a hip joint J.

Figure 1A:
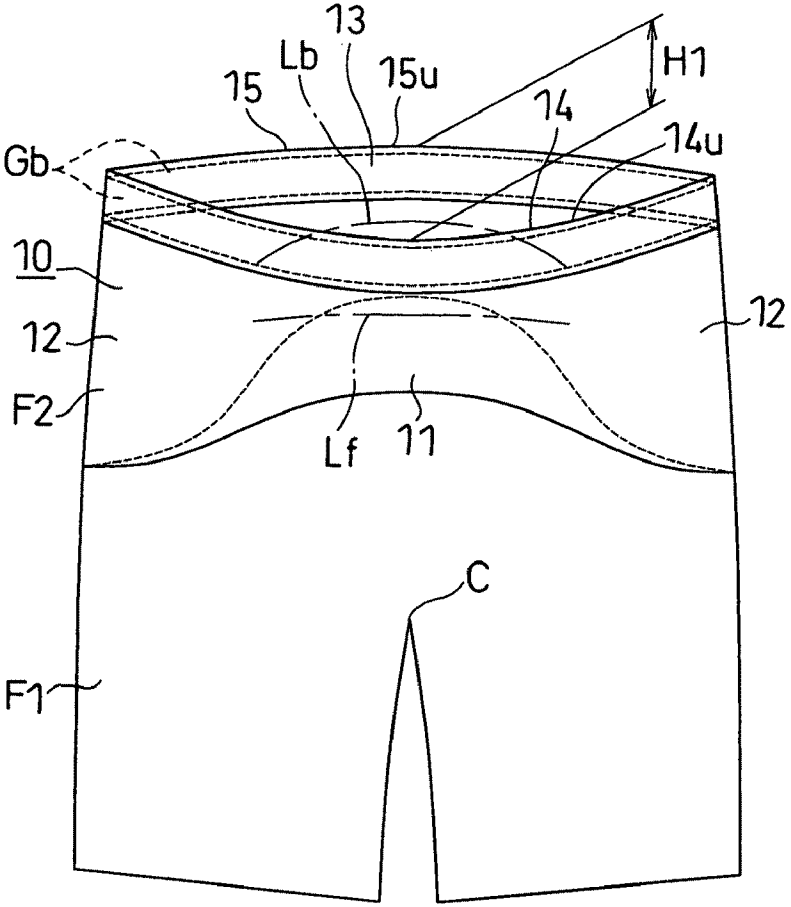
FIG. 1A is a schematic front view showing a pants-type athletic wear of the first embodiment of the present invention.

Whole Structure:

FIG. 1A shows a knee-length pants-type athletic wear 1.

As shown in FIG. 1A, the athletic wear 1 consists of clothing fabrics F1 and F2 that each has flexibility.

As shown in FIG. 2A and FIG. 2B, the athletic wear 1 is formed of the first clothing fabric F1 having small elastic modulus and the second clothing fabric F2 having larger elastic modulus than the first clothing fabric F1 (the second clothing fabric F2 is shown by rough dots).

As shown in FIG. 5A, FIG. 5B and FIG. 5C, when the wear 1 is worn, the first clothing fabric F1 covers circumference of lower part of a crotch C and the pelvis Bh, and the second clothing fabric F2 covers circumference of upper part of the pelvis Bh. The second clothing fabric F2 comprises a belt-like first belt part 10.

As shown in FIG. 4A, the first clothing fabric F1 is comprised of a fabric Fb being mostly whole wear. The first belt part 10 is comprised of the second clothing fabric F2 that a reinforcing clothing fabric Fs is overlapped to the fabric Fb in.

The upper part of the first belt part 10 is folded, and then the edge part of the folded upper part is sewn to the other first belt part 10, thereby forming a bag-like enclosure Gs. As shown in FIG. 2A and FIG. 2B, a strip-shaped rubber-like belt Gb is inserted into the enclosure Gs in whole waist circumference of the wear 1. In the first embodiment, width of the rubber-like belt Gb is 2.5 cm, for example.

First Belt Part 10:

As shown in two-dot chain lines in FIG. 2A and FIG. 2B, a belt front part 11, a pair of belt side parts 12 and a belt back part 13' is individually set regions that are formed by quadrisecting the first belt part 10 in a circumferential direction R. That is, the belt front part 11 is set to front of the wear, the belt back part 13 is set to back of the wear, and the belt side part 12 is set to side of the wear. The belt front part 11, belt side part 12 and belt back part 13 is formed continuously.

As shown in FIG. 2A, a front upper edge line 11*u* of the belt front part 11 is formed as convex downward. As shown in FIG. 2B, a back upper edge line 13*u* of the belt back part 13 is formed as convex upward.

As shown in FIG. 2A, a lower edge line 11*d* of the belt front part 11 is formed as convex upward. As shown in FIG. 2B, a lower edge line 13*d* of the belt back part 13 is formed as convex upward.

Figures 6A, 6B, 6C:
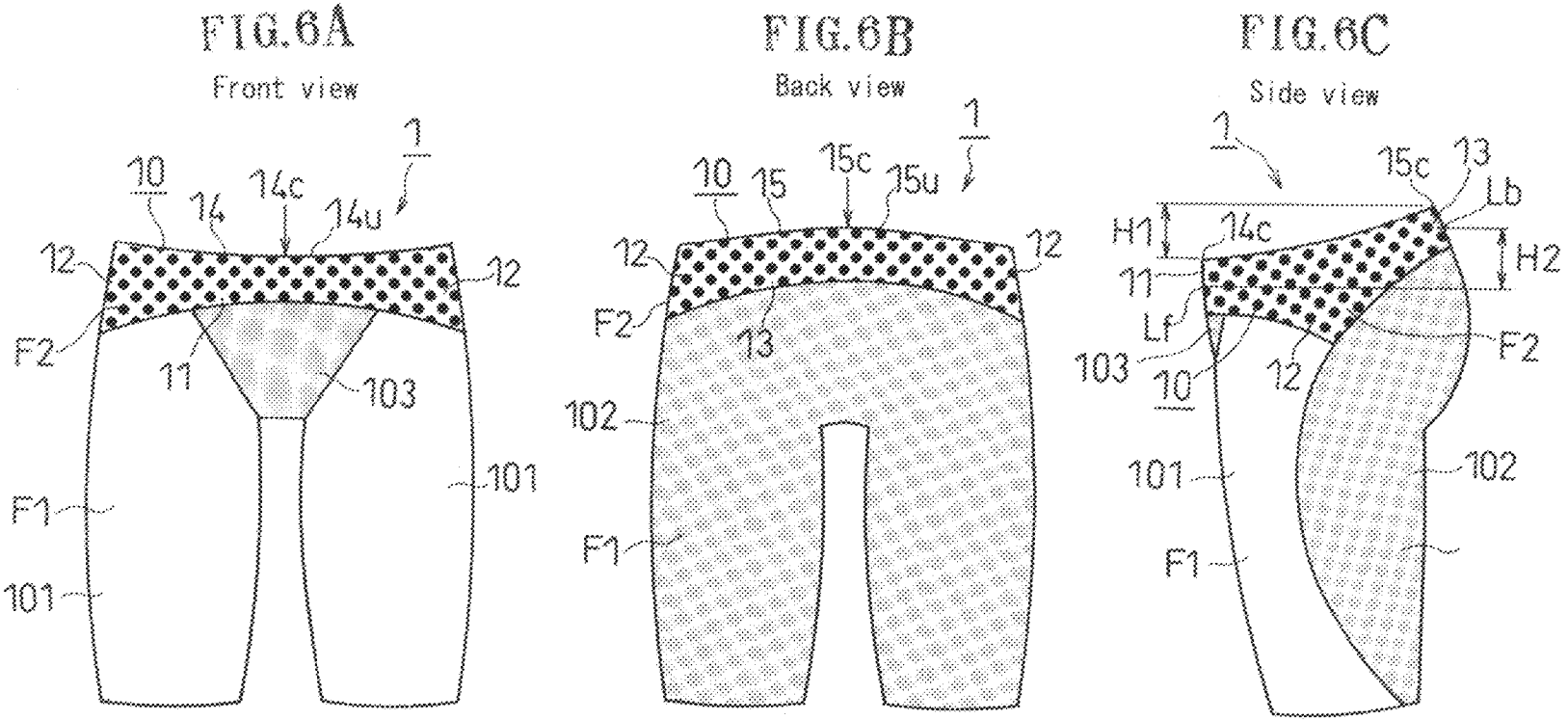
FIG. 6A is a schematic front view.
FIG. 6B is a schematic back view and FIG. 6C is a schematic side view and FIG. 6A to FIG. 6C each show when the pants-type athletic wear of the second embodiment of the present invention is worn.

Like FIG. 6A, FIG. 6B and FIG. 6C showing a second embodiment, in the first embodiment, upper edge lines 14 and 15 of the first belt part 10 slopes downward from a center 15*c* of the belt back part 13 toward a center 14*c* of the belt front part 11 through the belt side part 12. And, in the second embodiment shown in FIG. 6A to FIG. 6C, an enclosure Gs stores a thread-like rubber-like belt. The second embodiment is described later in detail.

As shown in FIG. 6A, FIG. 6B and FIG. 6C, in the first belt part 10, the center 15*c* of the back upper edge line 15 is arranged so as to be 5.0 cm upper than the center 14*c* of the front upper edge line 14, for example.

In FIG. 2B, a line Lb is a virtual back center line dividing vertically the belt back part 13 into two equal-width parts. In FIG. 2A, a line Lf is a virtual front center line dividing vertically the belt front part 11 into two equal-width parts. As shown in FIG. 1A, the first belt part 10 is formed so that the line Lb is arranged so as to be about 5.0 cm upper than line Lf on average.

Wearing Wear 1:

As shown in FIG. 5A, FIG. 5B and FIG. 5C, the first belt part 10 covers circumference of the pelvis Bh during wearing the wear 1.

As shown in FIG. 5A, the belt front part 11 covers front surface of an upper part Bhu of the pelvis Bh. As shown in FIG. 5B, the belt side part 12 covers side surface of the upper part Bhu of the pelvis Bh. As shown in FIG. 5C, the belt back part 13 covers back surface of the upper part Bhu of the pelvis Bh.

As shown in FIG. 5A, the front upper edge line 14 of the belt front part 11 is arranged along either upper edge of the pelvis Bh or a vicinity of the upper edge of the pelvis Bh. That is, level of the front upper edge line 14 is arranged in about level of central upper edge of sacral front surface or level of a vicinity of the central upper edge of sacral front surface. The front upper edge line 14 does not cover area that is upper than the pelvis Bh. The front upper edge line 14 does not cover area that is upper than the back upper edge line 15 of the belt back part 13.

The lower edge line 11*d* of the belt front part 11 is located in area that is upper than both the hip joint J located below the pelvis Bh and the greater trochanter Bb.

The first belt part 10 covers part of an anterior superior iliac spine BIs and a part of iliopsoas M1 in both ends of the front surface.

As shown in FIG. 5B, the belt side part 12 is arranged so as to be lower than upper edge of the iliac crest BIc and be upper than the greater trochanter Bb. It is preferable that an upper edge line of the belt side part 12 is adjacent to the iliac crest BIc.

A lower edge 12*d* of the belt side part 12 is formed so as to be convex downward toward almost center of the circumferential direction R in the belt side 12. So, a lowermost end of the belt side part 12 is close to the greater trochanter Bb.

Height of the belt side part 12 is set from ½ to ⅘ of a distance between the great trochanter Bb and the iliac, crest BIc. So, the belt side part 12 covers a gluteus medius muscle M2 from its middle part to its upper part.

As shown in FIG. 5B, both force Wf applied to the pelvis Bh from the front surface and force Wb applied to the pelvis Bh from the back surface apply the pelvis Bh under offset condition.

That is, in area upper than area that force Wf applies to the pelvis Bh from the front surface in, force Wb applies to the pelvis Bh from the back surface.

As shown in FIG. 5C, the belt back part 13 covers an upper part of the sacrum Bs. In both sides of the sacrum Bs, it is preferable that back upper edge line 13*u* of the belt back part 13 is close to an upper edge of the ilium Bt and is located lower than the upper edge of the ilium Bt. The belt back part 13 covers an upper edge of the sacrum Bs or a vicinity of the upper edge of the sacrum Bs while does not cover lower edge of the sacrum Bs. The belt back part 13 and the belt side part 12 do not cover a quadratus lumborum muscle M3.

Third Embodiment

A third embodiment of the present invention is described below with reference to FIG. 7A, FIG. 7B and FIG. 7C.

Figures 7A, 7B, 7C:
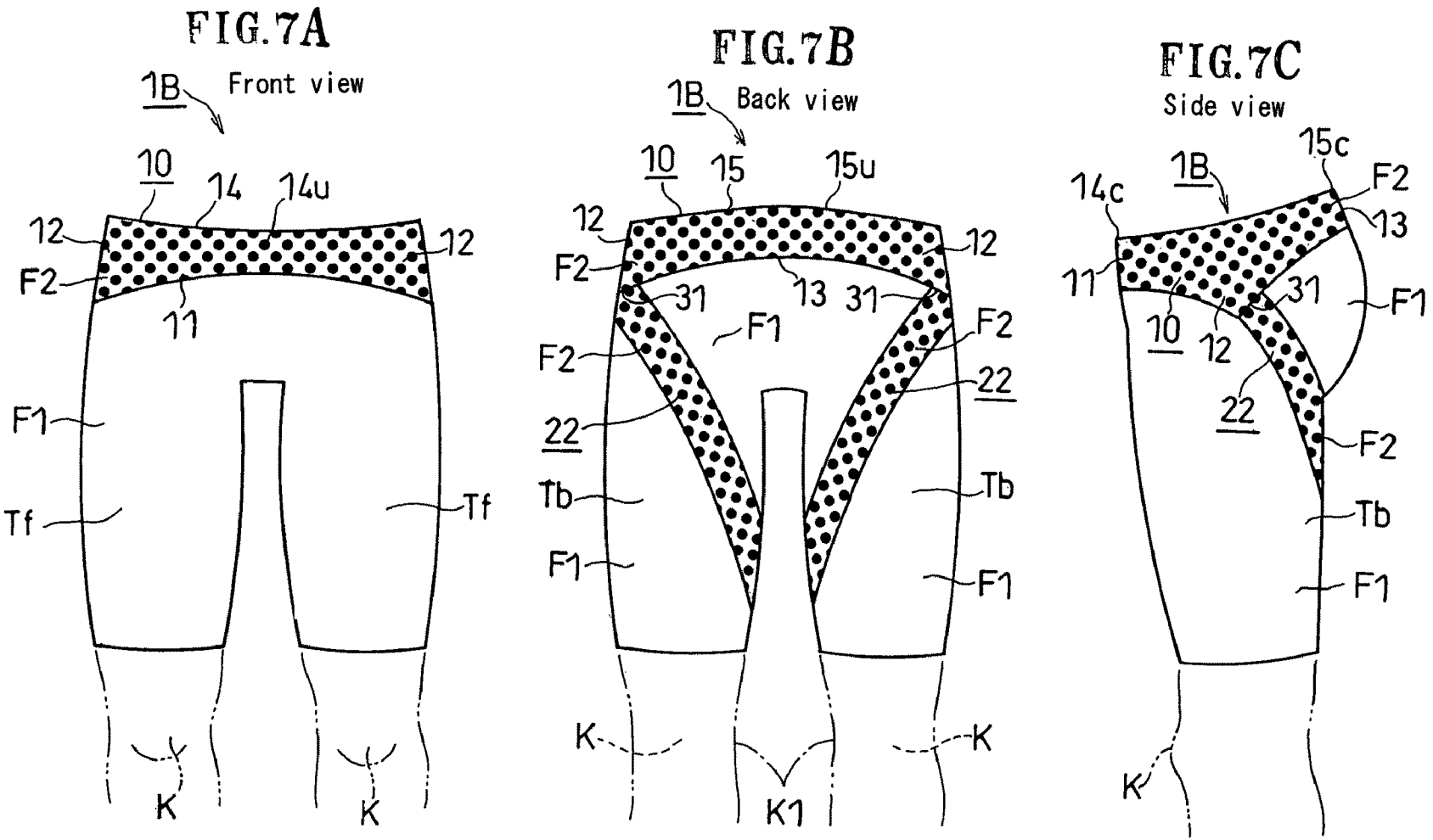
FIG. 7A is a schematic front view.
FIG. 7B is a schematic back view and FIG. 7C is a schematic side view and FIG. 7A to FIG. 7C each show a pants-type athletic wear of the third embodiment of the present invention.

As shown in FIG. 7B and FIG. 7C, an athletic wear 1B comprises a pair of second belt parts 22. The second belt parts 22 each is formed of a second clothing fabric F2, and elastic modulus E3 of the second clothing fabric F2 along longitudinal direction is larger than elastic modulus E1 of a first clothing fabric F1.

Upper edge of the second belt parts 22 each has a first connection part 31 that is connected to a lower edge of a first belt part 10 at a posterior thigh Tb in lateral side of a pelvis Bh (FIG. 5B). The second belt part 22 is formed as belt-like extending from the first connection part 31 to medial side K1 of a knee K. Meanwhile, as shown in FIG. 7A, the second belt part 22 is not arranged over an anterior thigh Tf.

And, elastic modulus E3 of the second clothing fabric F2 along the longitudinal direction and elastic modulus E2 of the second clothing fabric F2 along waistline are the same value.

The other structures are similar to those of the first embodiment, for which like members are denoted by like reference numerals and will not be further described below.

Forth Embodiment

A forth embodiment of the present invention is described below with reference to FIG. 8A, FIG. 8B and FIG. 8C.

Figure 8A:
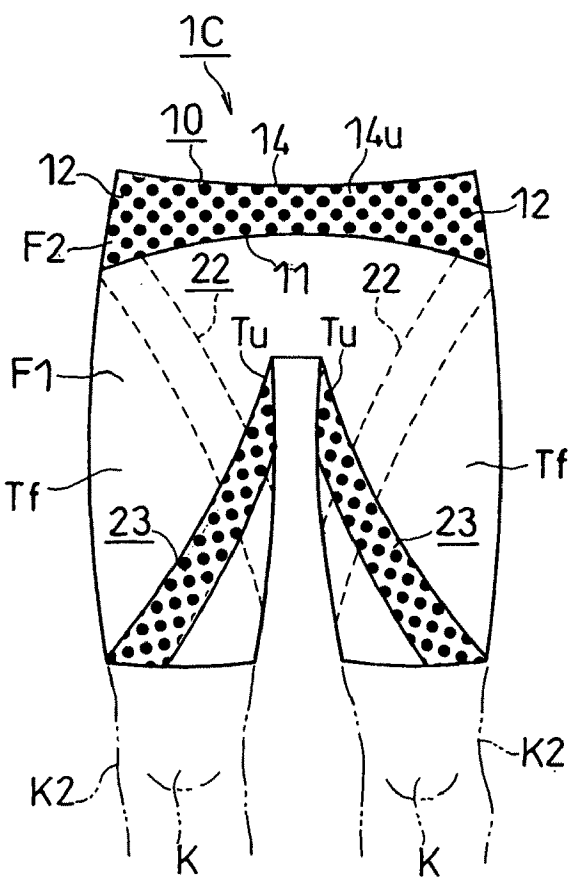
FIG. 8A is a schematic front view.
Figure 8B:
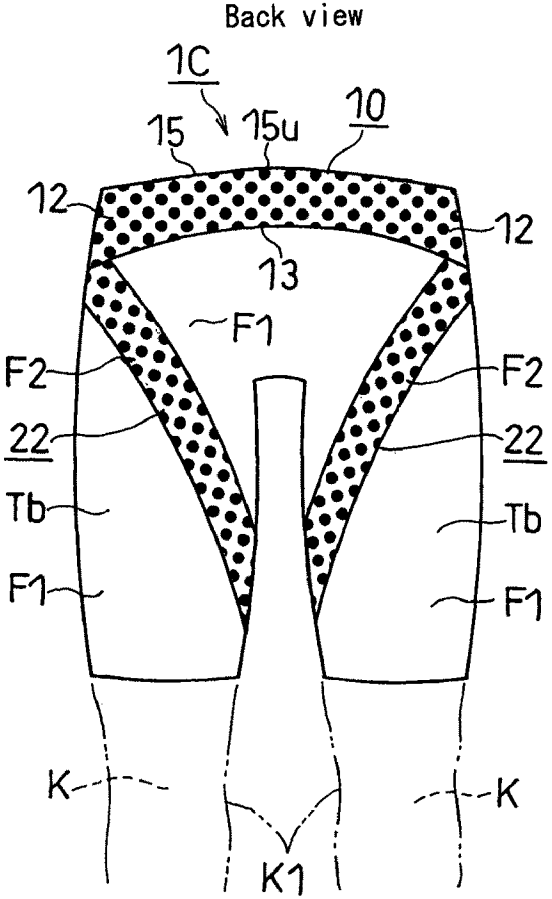
FIG. 8B is a schematic back view and FIG. 8C is a schematic side view and FIG. 8A to FIG. 8C each show a pants-type athletic wear of the fourth embodiment of the present invention.
Figure 8C:
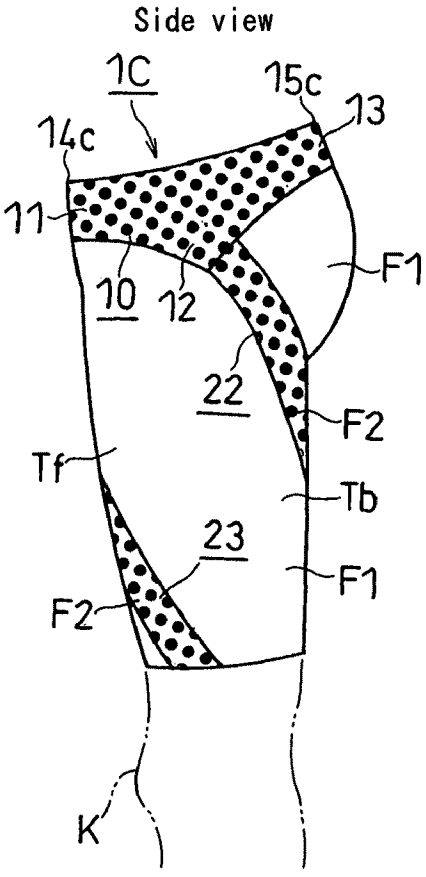

As shown in FIG. 8A and FIG. 8C, an athletic wear 1C comprises a pair of third belt parts 23. The third belt parts 23 each is formed of a second clothing fabric F2, and elastic modulus E3 of the second clothing fabric F2 along longitudinal direction is larger than elastic modulus E1 of a first clothing fabric F1.

The third belt parts 23 is formed as belt-like extending from medial side Tu of a vicinity of an upper edge of an anterior thigh Tf to lateral side K2 of a knee K.

And, elastic modulus E3 of the second clothing fabric F2 along the longitudinal direction and elastic modulus E2 of the second clothing fabric F2 along waistline are the same value.

The other structures are similar to those of the third embodiment, for which like members are denoted by like reference numerals and will not be further described below.

Fifth Embodiment

A fifth embodiment of the present invention is described below with reference to FIG. 9.

Figure 9:
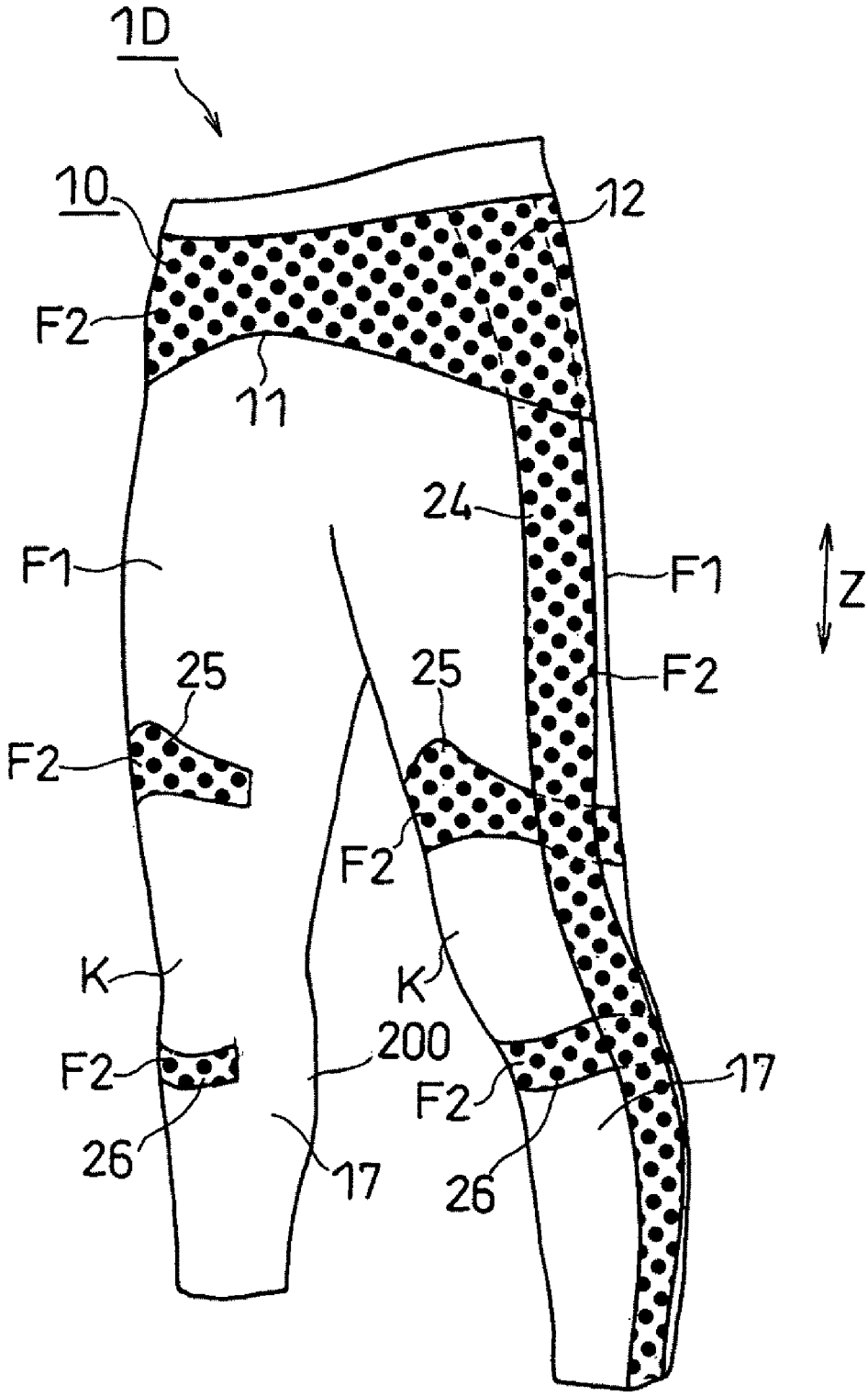
FIG. 9 is a schematic perspective view showing a tights-type athletic wear of the fifth embodiment of the present invention.

As shown in FIG. 9, an athletic wear 1D is what is called tights-type wear, and comprises a leg portion 17 covering a knee K and a calf 200 positioned below the knee K. The athletic wear 1D comprises a first support part 25, a second support part 26 and a second connection part 24.

The first support part 25, the second support part 26 and the second connection part 24 are formed of a second clothing fabric F2 having elastic modulus larger than elastic modulus of a first clothing fabric F1.

That is, elastic modulus E4 of the first and second support parts 25, 26 along leg girth direction is lager than elastic modulus E1 of the first clothing fabric F1, and elastic modulus E5 of the second connection part 24 along the longitudinal direction is larger than elastic modulus E1 of the first clothing fabric F1.

The first support part 25 covers front surface above a vicinity of the knee K. The second support part 26 covers front surface below the vicinity of the knee K.

The second connection part 24 is formed so that the second connection part 24 continuously extends along longitudinal direction Z of leg through the first and second support part 25, 26 and side part of a belt side part 12 of a first belt part 10.

In addition, elastic modulus E4 of the second clothing fabric F2 along leg girth direction of the first and second support part 25 and 26, elastic modulus E5 of the second clothing fabric F2 along the longitudinal direction of the second connection part 24, and elastic modulus E2 of the second clothing fabric F2 along waistline of the second clothing fabric F2 are the same value.

The other structures are similar to those of the first embodiment, for which like members are denoted by like reference numerals and will not be further described below.

Second Embodiment and Sixth Embodiment

Figure 10A:
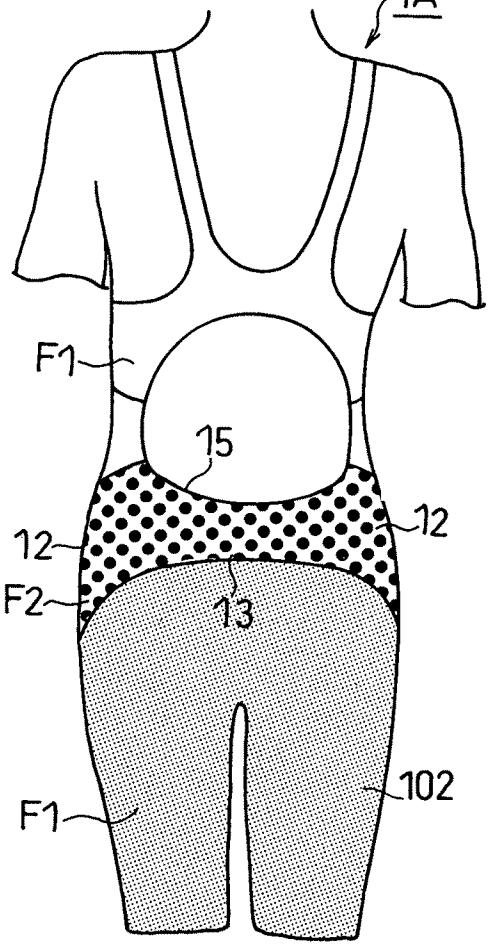
FIG. 10A is a schematic back view.
Figure 10B:
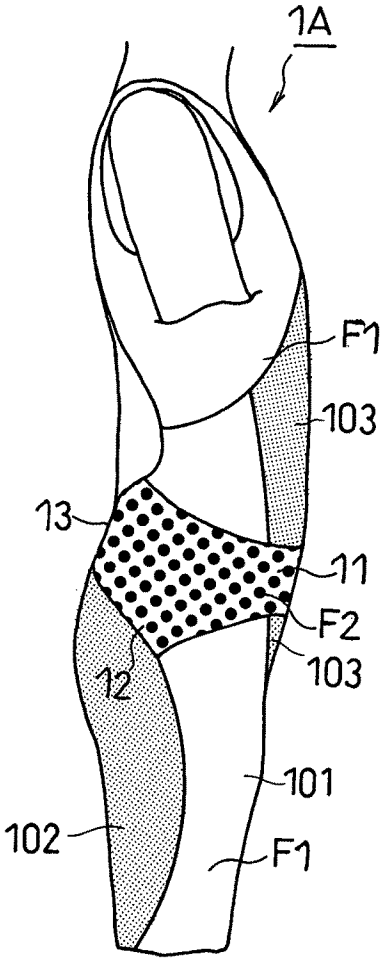
FIG. 10B is a schematic side view and FIG. 10C is a schematic front view and FIG. 10A to FIG. 10C each show a suit-type athletic wear of the sixth embodiment of the present invention.
Figure 10C:
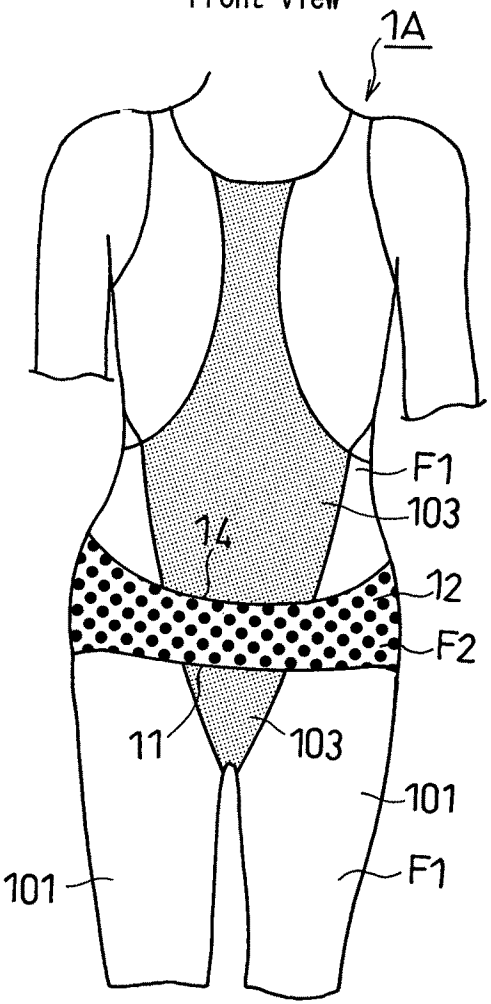

FIG. 6A to FIG. 6C each shows men's swimwear. An athletic wear 1A shown in FIG. 10A, FIG. 10B and FIG. 10C shows a sixth embodiment, and is what the swimwear 1 of second embodiment is applied to women's swimwear.

In FIG. 6A to FIG. 6C, a first clothing fabric F1 covers a first area 101 that is front surface of a thigh and a second area 102 that is back surface of a thigh and buttocks, and elastic modulus of the first clothing fabric F1 covering the second area 102 is lager than elastic modulus of the first clothing fabric F1 covering the first area 101.

The first clothing fabric F1 also covers a third area 103 that is comprised of hypogastrium and elastic modulus of the first clothing fabric F1 in the third area 103 is larger than elastic modulus of the first clothing fabric F1 covering the first area 101.

For example, elastic modulus of the first clothing fabric F1 in the second and third area 102 and 103 is 3.3 N/cm, and elastic modulus of the first clothing fabric F1 in the first area 101 is 1.2N/cm. In FIG. 6A to FIG. 6C, fine dots are over the second and third area 102 and 103. In this case, elastic modulus E1 of the first clothing fabric F1 is obtained by the following formula (2):

$$E1=(E_{11}\cdot A_{11}+E_{12}\cdot A_{12}+\ldots E_{1n}\cdot A_{1n})/A1 \quad (2)$$

$E_{1i}$: elastic modulus of clothing fabric in area covered by first clothing fabric $A_{1i}$: planer dimension of area covered by clothing fabric having elastic modulus $E_{1i}$ A1: total planar dimension of first clothing fabric covering lower pelvis.

In women's swimwear shown in FIG. 10A to FIG. 10C, fine dots are over the second and third area 102 and 103, and parts having elastic modulus similar to elastic modulus of the second and third area 102 and 103.

The other structures of the wear 1A of the sixth embodiment are similar to those of the athletic wear 1, for which like members are denoted by like reference numerals and will not be further described below.

Test Examples and Comparative Examples

Test example and comparative examples are shown below in order to clarify advantages of the present invention.

A test example 1, a test example 2, a test example 3, a comparative example 1, a comparative example 2 and a comparative 3 that are used for test is described below.

And, in what follows, "elastic modulus of a rubber-like belt Gb" means elastic modulus when the first clothing fabric F1 is overlapped on frontal surface and rear surface of the rubber-like belt Gb.

Test Example 1

In the test example 1, the athletic wear 1 in FIG. 1A is set so that elastic modulus of the first clothing fabric F1 along waistline R is 1.1 N/cm and elastic modulus of a second clothing fabric F2 along the waistline R is 4.6 N/cm. Elastic modulus of the rubber-like belt Gb is 18.4 N/cm.

Test Example 2

In the test example 2, the athletic wear 1 in FIG. 1A is set so that elastic modulus of the first clothing fabric F1 along the waistline R is 1.1 N/cm and elastic modulus of the second clothing fabric F2 along the waistline R is 8.0 N/cm. Elastic modulus of the rubber-like belt Gb is 25.7 N/cm.

So, pressure and couple of force applied to an examinee by the first belt part 10 (FIG. 1A) in the test example 1 is set smaller than pressure and couple of force applied to an examinee by the first belt part 10 in the test example 2.

Comparative Example 1

In the comparative example 1, the athletic wear 1 in FIG. 1 is set so that elastic modulus of the first and second clothing fabric F1 and F2 along the waistline R is 1.1 N/cm. Elastic modulus of the rubber-like belt Gb in the comparative example is 6.1 N/cm.

Comparative Example 2

In the comparative example 2, a commonly-used wear 100 shown in FIG. 1B, FIG. 3A and FIG. 3B is used.

As shown in FIG. 1B, the wear 100 in the comparative example 2 comprises a third clothing fabric F3, a forth clothing fabric F4 and a fifth clothing fabric F5.

In an upper edge part of the wear 100, the rubber-like belt Gb is stored in whole circumference of the waistline of the wear 100.

As shown in FIG. 1A and FIG. 1B, height from a crutch C to a front upper edge line 14A of the wear 100 is set higher than height from the crutch C to a front upper edge line 14 of the athletic wear 1 in FIG. 1A. So, the rubber-like belt Gb tightens area upper than the pelvis Bh (FIG. 5A and FIG. 5B) of a wearer.

Maximum offset amount H1 of an upper edge line of the wear 100 is about 3 cm.

As shown in FIG. 3A and FIG. 3B, the fourth clothing fabric F4 is used in both sides 112 and a back surface 113 of the wear 100. The fifth clothing fabric F5 that is formed so as to be convex downward toward a center of the wear 100 is used in a belt front part 111.

Elastic modulus of the third clothing fabric F3 is 1.7 N/cm, elastic modulus of the fourth clothing fabric F4 is 4.4 N/cm and elastic modulus of the fifth clothing fabric F5 is 4.9 N/cm. And, elastic modulus of the rubber-like belt in the comparative example 2 is each 11.6 N/cm in abdominal, 18.0 N/cm in back.

Test example 3, test example 4 and comparative example 3:

Men's swimwear shown in FIG. 6A to FIG. 6C is used in a test example 3, and women's swimwear shown in FIG. 10A to FIG. 10C is used in a test example 4. Elastic modulus of first clothing fabric in the test example 3 and 4 is 1.2 N/cm in front surface, 3.3 N/cm in back surface and elastic modulus of second clothing fabric is 6.7 N/cm. And, the rubber-like belt used in the test example 3 is thread rubber.

Commonly-used swimwear is used in a comparative example 3.

Measuring Method for Elastic Modulus

Elastic modulus of clothing fabric is measured in the following specifications in compliance with JIS-L1018.

Testing machine: universal testing machine (Instron Model 5565)

Tensile direction: waistline direction of wear

Tension rate: 20.0 cm/min

Chuck to chuck distance: 10.0 cm

Clothing fabric size: width 5.0 cm, length 20.0 cm

Rubber-like belt sample size in the test example 1, the test example 2 and the comparative example 1: width 2.5 cm, length 20.0 cm Rubber-like belt sample size in the comparative examples: width 3.0 cm, length 20.0 cm Elastic modulus of clothing fabric is calculated by measuring intensity of load per unit width to unit stretch when the above samples stretch by 20%.

Short-Distance Running Test

FIG. 11A and FIG. 11B each shows results of short-distance running test using the comparative example 1 and test example 1.

In this test, 14 male sprinters are selected as examinees, and change of running speed and propulsive force when the examinees dash in 20 m is measured.

The result shows that, as shown in FIG. 11A, running speed increases 0.5% on average, and as shown in FIG. 11B, propulsive impulse increases 3% on average.

These increases correspond to improving a record by 0.05 seconds if a runner runs 100 meters in 10 seconds.

Change in Kick Motion

FIG. 12A and FIG. 12B show results of kick motion test using the comparative example 1 and the test example 1.

In this test, 5 male distance runners are selected as examinees, and change in kick motion is measured.

The result shows that, as shown in FIG. 12A, force in traverse direction representing instability of the kick motion decreases in compared with the comparative example 1. And, as shown in FIG. 12B, propulsive efficiency in the test example 1 increases 8% on average in compared with the comparative example 1. In the test example 1, unintended movement of the waist in right-and-left direction during running decreases.

Jump tests 1, 2 and 3 shown below are examined. In this test, an examinee runs and jumps vertically, and height of jump is measured by calculating vertical displacement of a reflective marker attached on the examinee's waist. An examinee wearing wear used in the examples jumps 4 times in total that is 2 sets of 2 jumps.

Jump Test 1:

FIG. 13A and FIG. 13B show results of the jump test 1 using the comparative example 1 and the test example 2.

In the jump test 1, 5 male basketball players and 3 valley ball players, in total 8, are selected as examinees, and height of jump is measured.

The results show that, as shown in FIG. 13A, height of jump in the test example 2 increases by 1 cm on average as compared to the comparative example 1. And, as shown in FIG. 13B, variability in height of jump in the test example 2 decreases as compared to the comparative example 1, and failure of jump reduces.

In the jump test 1, muscle efficiency of gluteus maximus muscle and hamstring is measured by dividing integral value of kicking force applied to floor by an examinee by activity amount of muscle.

As shown in FIG. 14A, muscle efficiency of gluteus maximus muscle is the largest in the test example 2, the second largest in the comparative example 1, and followed by the test example 1. In particular, muscle efficiency in the test example 2 is about 1.5 times larger than the test example 1 and the comparative example 1.

As shown in FIG. 14B, muscle efficiency of hamstring is the largest in the test example 2, the second largest in the test example 1, and followed by the comparative example 1.

These results show that muscle efficiency of gluteus maximus muscle and hamstring increases in synchronization with increasing amount of couple of force applied to the pelvis.

It is considered that gluteus medius muscle M2 (FIG. 5B) supporting the pelvis acts actively, and muscle length is appropriate because the pelvis erects, thereby muscle efficiency of gluteus maximus muscle and hamstring that both mainly act in jump motion is improved.

Jump Test 2:

In this test, 5 adult males playing competitive sports routinely are selected as examinees.

The results show that, as shown in FIG. 15A, average of height of jump is the largest in the test example 2, the second largest in the test example 1, the third largest in the comparative example 2, and followed by the comparative example 1.

A wear used in the comparative example 2 and a wear used in the test example 1 are formed of clothing fabric having similar elastic modulus. Offset force applies to wearer's body in both wears.

However, there is difference in measurements between the comparative example 2 and the test example 1, and the reason why such difference occurs is considered below.

The front upper edge line 14A of the rubber-like belt Gb of the wear 100 used in the comparative example 2 shown in FIG. 1B is arranged in area upper than the pelvis Bh of an wearer.

In contrast, the front upper edge line 14 and a back upper edge line 15*u* of the rubber-like belt Gb of the athletic wear used in the test example 1 is not arranged in area upper than the pelvis Bh of a wearer.

In addition, offset amount between the front upper edge line and the back upper edge line of the rubber-like belt Gb of the athletic wear 1 in the test example is greater than offset amount between the front upper edge line and back upper edge line of the rubber-like belt Gb of the commonly-used wear 100.

That is, the athletic wear 1 used in the test example 1 differs from the wear 100 in (1) front upper edge line of rubber-like belt Gb is not arranged in area upper than the pelvis and (2) offset amount in the athletic wear 1 is greater than offset amount in the wear 100.

Since the front upper edge line of the rubber-like belt Gb is not arranged in area upper than the pelvis and offset amount is great in the athletic wear 1, couple of force caused by offset couple of force that erects the pelvis is great. So, it is assumed that the pelvis is easy to be erected.

In contrast, the front upper edge line 14A of the rubber-like belt is arranged in area upper than the pelvis Bh and the offset amount is little, and offset couple of force is little. So, it is assumed that the pelvis is difficult to be erected.

Based on the above understanding, there is clearly difference in structure between the athletic wear 1 and the wear 100, and it is considered that difference in amount of couple of force applying the pelvis Bh influences the measurements.

Measurements difference between the test example 1 and the test example 2 is considered below.

As aforementioned, elastic modulus of the second clothing fabric F2 in the test example 1 is 4.6 N/cm, elastic modulus of the rubber-like belt Gb in the test example 1 is 18.4 N/cm, elastic modulus of the second clothing fabric F2 in the test example 2 is 8.0 N/cm, and elastic modulus of the rubber-like belt Gb in the test example 2 is 25.7 N/cm.

So, pressure and couple of force applied to the pelvis Bh by the first belt part 10 (FIG. 1A) in the test example 2 is greater than pressure and couple of force applied to the pelvis Bh by the first belt part 10 in the test example 1.

When pressure applied to the pelvis is great, stability of the pelvis is achieved. And, since couple of force applied to the pelvis is great, the pelvis is easy to be erected.

Based on the above understanding, it is considered that the test example 1 and the test example 2 differ in elastic modulus of the second clothing fabric F2 and the rubber-like belt Gb, and difference in pressure and couple of force applied to the pelvis Bh influences the measurements.

Jump Test 3:

A jump test similar to the jump test 1 and 2 is conducted with average 8 adult men, as examinees, wearing wear used in the test example 1 and the comparative example 1. The result shows that, as shown in FIG. 15B, jump force in the test example 1 is greater than the comparative example 1.

Swimming Test:

Average in propulsive distance in one stroke during swimming is measured with 7 male students and 6 female students who all belong to college swimming club wearing swimwear used in the comparative example 3 and the test examples 3 and 4 as examinees. The result shows that, as shown in FIG. 16A, the stroke distance increases in length by 2 cm on average.

In addition, in the test examples 3 and 4, 70% examines realize that their waist is restrained from sinking because their waist rises in the arrow direction of FIG. 16B, and it is assumed that propulsive distance right after kicking an wall during swimming increases as compared with the comparative example 3.

INDUSTRIAL APPLICABILITY

The present invention is used in various athletic wears such as for swimming, wrestling and track and field.

What is claimed is:

1. An athletic wear comprising flexible clothing fabrics, wherein:

the athletic wear is formed of a first flexible clothing fabric and a second flexible clothing fabric, an elastic modulus of the second clothing fabric along a waistline is larger than an elastic modulus of the first clothing fabric along the waistline, the second clothing fabric being designed to enclose a pelvis region and to enclose only the pelvis region in both sides of a sacrum, a crotch and a circumference of a lower part of a pelvis in the wear are covered with the first clothing fabric, a circumference of an upper part of the pelvis in the wear is covered with the second clothing fabric to form a first belt part, wherein the first belt part comprises:

a belt front part covering a front surface of the upper part of the pelvis, a belt back part covering a back surface of the upper part of the pelvis, and a pair of belt side parts each covering a side surface of the upper part of the pelvis, the belt front part, the belt back part and the belt side parts are set individually to four regions into which the first belt part is equally divided in a circumferential direction, an upper edge line of the first belt part is sloped downward from the belt side part toward a center of the belt front part, a front upper edge line of the upper edge line of the belt front part is arranged in a level of one of an upper edge of the pelvis and a vicinity thereof, avoids covering an upper area than the pelvis and avoids covering an upper area than a back upper edge line of the upper edge line of the belt back part, a center of the back upper edge line is arranged in a region that is between 4 cm and 6 cm upper than a center of the front upper edge line, and the first belt part is formed so that a virtual back center line vertically dividing the belt back part into two parts is in a region that is 4 cm to 6 cm on an average upper than a virtual front center line vertically dividing the belt front part into two parts.

2. An athletic wear as claimed in claim 1, wherein a value computed by dividing the elastic modulus of the second clothing fabric along the waistline by the elastic modulus of the first clothing fabric along the waistline is set from 2.0 to 25.

3. An athletic wear as claimed in claim 1, wherein the elastic modulus of the first clothing fabric along the waistline is set from 0.3 to 3.0 N/cm, the elastic modulus of the second clothing fabric along the waistline is set from 3.0 to 14 N/cm, and a value computed by subtracting the elastic modulus of the first clothing fabric from the elastic modulus of the second clothing fabric is set from 2.7 to 13.7 N/cm.

4. An athletic wear as claimed in claim 1, wherein the front upper edge line of the belt front part is formed to be convexed downward, and the back upper edge line of the belt back part is formed as one of being convexed upward and being generally horizontal.

5. An athletic wear as claimed in claim 1, wherein the first belt part covers at least a part of an anterior superior iliac spine in a vicinity of both ends of the front surface, and covers a part of an iliopsoas, and the belt back part covers a part of the sacrum.

6. An athletic wear as claimed in claim 5, wherein the belt back part covers one of an upper edge of the sacrum and a vicinity thereof but avoids covering a lower edge of the sacrum.

7. An athletic wear as claimed in claim 5, wherein the belt side parts are arranged in an area that is lower than an iliac crest and upper than a greater trochanter.

8. An athletic wear as claimed in claim 7, wherein a lower edge line of the belt side parts is formed to be convexed downward toward a vicinity of a center in the circumferential direction of the belt side parts, and a lowermost end of the belt side parts is adjacent to the greater trochanter, and a height of the belt side parts is set from 1/2 to 4/5 of a distance between the greater trochanter and the iliac crest.

9. An athletic wear as claimed in claim 1, wherein the athletic wear is a swimwear.

10. An athletic wear as claimed in claim 9, further comprising a pair of second belt parts formed of a clothing fabric that differs from the first clothing fabric, wherein an elastic modulus of the second belt parts in the longitudinal direction is larger than the elastic modulus of the first clothing fabric, and the second belt parts each have a first connection part at which an upper end of the second belt part is connected to a lower end of the first belt part at a posterior region of a thigh in an outer side of the pelvis, and are formed like a belt toward an inner side of a knee from the first connection part.

11. An athletic wear as claimed in claim 10, further comprising a pair of third belt parts formed of a clothing fabric that differs from the first clothing fabric, wherein an elastic modulus of the third belt parts in the longitudinal direction is larger than the elastic modulus of the first clothing fabric, and the third belt parts each are formed like a belt toward an outer side of the knee from around an upper edge of an anterior region of the thigh.

12. An athletic wear as claimed in claim 1, further comprising a leg part covering the knee and a calf, a support part formed of the second clothing fabric to cover at least a front surface above around the knee, and a second connection part connecting the support part and the belt side parts along a longitudinal direction of a leg.

13. An athletic wear as claimed in claim 1, wherein an enclosure running along the waistline is provided in an upper edge portion of the first belt part, the enclosure is formed by folding the second clothing fabric so that the second clothing fabric is doubled, and a rubber belt having rubber elasticity to be elastic along the waistline is put in the enclosure.

14. An athletic wear as claimed in claim 13, wherein an elastic modulus of the rubber belt is larger than the elastic modulus of the second clothing fabric.

15. An athletic wear as claimed in claim 14, wherein the elastic modulus of the rubber belt is set from 17 to 40 N/cm, and a width of the rubber-like belt is set from 2.0 to 3.5 cm.

16. An athletic wear as claimed in claim 9, wherein a value computed by dividing the elastic modulus of the second clothing fabric along the waistline by the elastic modulus of the first clothing fabric along the waistline is set from 1.5 to 7.0.

17. An athletic wear as claimed in claim 9, wherein the elastic modulus of the first clothing fabric along the waistline is set from 1.2 to 3.5 N/cm, the elastic modulus of the second clothing fabric along the waistline is set from 5.0 to 14.0 N/cm, and a value computed by subtracting the elastic modulus of the first clothing fabric from the elastic modulus of the second clothing fabric is set from 3.7 to 12.0 N/cm.

18. An athletic wear as claimed in claim 9, wherein the first clothing fabric covers a first region that is a front surface of the thigh and a second region that is a back surface of the thigh and buttocks, and an elastic modulus of a part of the first clothing fabric covering the second region is larger than an elastic modulus of a part of the first clothing fabric covering the first region.

19. An athletic wear as claimed in claim 18, wherein the elastic modulus of a part of the first clothing fabric in a third region that is a hypogastrium covered by the first clothing fabric is larger than the elastic modulus of the part of the first clothing fabric covering the first region.

20. An athletic wear as claimed in claim 1, wherein an upper edge line of the belt side parts is arranged along one of the iliac crest and a vicinity of a lower side thereof.

21. An athletic wear as claimed in claim 1, wherein the back upper edge line of the upper edge line of the belt back part is arranged, in a part of the sacrum, at one of the upper edge of the sacrum and a vicinity of the upper side of the sacrum, and in both sides of the sacrum, the back upper edge line is arranged at one of the upper edge of the pelvis and a vicinity of the lower side of the pelvis.

22. An athletic wear comprising flexible clothing fabrics, wherein:

the athletic wear is formed of a first flexible clothing fabric and a second flexible clothing fabric, an elastic modulus of the second clothing fabric along a waistline is larger than an elastic modulus of the first clothing fabric along the waistline, the second clothing fabric being designed to enclose a pelvis region and to enclose only the pelvis region in both sides of a sacrum, a crotch and a circumference of a lower part of the pelvis in the wear are covered with the first clothing fabric, a circumference of an upper part of the pelvis in the wear is covered with the second clothing fabric to form a first belt part, wherein the first belt part comprises:

a belt front part covering a front surface of the upper part of the pelvis, a belt back part covering a back surface of the upper part of the pelvis, and a pair of belt side parts each covering a side surface of the upper part of the pelvis, the belt front part, the belt back part and the belt side parts are set individually to four regions into which the first belt part is equally divided in a circumferential direction, an upper edge line of the first belt part is sloped downward from the belt side part toward a center of the belt front part, a front upper edge line of the upper edge line of the belt front part is arranged in a level of one of an upper edge of the pelvis and a vicinity thereof, avoids covering an upper area than the pelvis and avoids covering an upper area than a back upper edge line of the upper edge line of the belt back part, a center of the back upper edge line is arranged in a region that is 4 cm to 6 cm upper than a center of the front upper edge line, and the first belt part is formed so that a virtual back center line vertically dividing the belt back part into two parts is in a region that is 4 cm to 6 cm on an average upper than a virtual front center line vertically dividing the belt front part into two parts, wherein the front upper edge line of the belt front part is formed to be convexed downward, and the back upper edge line of the belt back part is formed as one of being convexed upward and being generally horizontal, wherein a lower edge line of the belt front part is formed to be convexed upward, and a lower edge line of the belt back part is formed to be convexed upward.

* * * * *